US010304672B2

(12) United States Patent
Fedosenko et al.

(10) Patent No.: US 10,304,672 B2
(45) Date of Patent: May 28, 2019

(54) MASS SPECTROMETER, USE THEREOF, AND METHOD FOR THE MASS SPECTROMETRIC EXAMINATION OF A GAS MIXTURE

(71) Applicants: Carl Zeiss SMT GmbH, Oberkochen (DE); Carl Zeiss Microscopy GmbH, Jena (DE)

(72) Inventors: Gennady Fedosenko, Aalen (DE); Michel Aliman, Oberkochen (DE); Hin Yiu Anthony Chung, Ulm (DE); Albrecht Ranck, Aalen (DE); Leonid Gorkhover, Ulm (DE)

(73) Assignees: Carl Zeiss SMT GmbH, Oberkochen (DE); Carl Zeiss Microscopy GmbH, Jena (DE)

( * ) Notice: Subject to any disclaimer, the term of this patent is extended or adjusted under 35 U.S.C. 154(b) by 0 days.

(21) Appl. No.: 14/967,699

(22) Filed: Dec. 14, 2015

(65) Prior Publication Data

US 2016/0111269 A1 Apr. 21, 2016

Related U.S. Application Data

(63) Continuation of application No. PCT/EP2014/053361, filed on Feb. 20, 2014.

(30) Foreign Application Priority Data

Jul. 10, 2013 (DE) ..... 10 2013 213 501

(51) Int. Cl.
*H01J 49/04* (2006.01)
*H01J 49/14* (2006.01)
(Continued)

(52) U.S. Cl.
CPC ..... *H01J 49/04* (2013.01); *H01J 49/0027* (2013.01); *H01J 49/105* (2013.01); *H01J 49/14* (2013.01); *H01J 49/145* (2013.01); *H01J 49/147* (2013.01)

(58) Field of Classification Search
CPC ..... H01J 49/04; H01J 49/0027; H01J 49/14; H01J 49/145; H01J 49/147
See application file for complete search history.

(56) References Cited

U.S. PATENT DOCUMENTS 5,107,109 A 4/1992 Stafford, Jr. et al.
5,572,022 A 11/1996 Schwartz et al.
(Continued)

FOREIGN PATENT DOCUMENTS

DE 199 30 894 A1 1/2001
DE 10 2007 013 693 A1 9/2007
(Continued)

OTHER PUBLICATIONS

Taiwanese Office Action and Search Report, with translation thereof, for TW Appl No. 103105973, dated Feb. 17, 2016.
(Continued)

*Primary Examiner* — Nicole M Ippolito
*Assistant Examiner* — Sean M Luck
(74) *Attorney, Agent, or Firm* — Fish & Richardson P.C.

(57) ABSTRACT

The disclosure relates to a mass spectrometer for mass spectrometric examination of gas mixtures, including: an ionization device and an ion trap for storage and mass spectrometric examination of the gas mixture. In one aspect of the disclosure, the ionization device is embodied for supplying ions and/or metastable particles of an ionization gas and/or for supplying electrons to the ion trap for ionizing the gas mixture to be examined and the mass spectrometer is embodied to determine the number of ions and/or meta-
(Continued)

stable particles of the ionization gas present in the ion trap and/or the number of ions of a residual gas present in the ion trap prior to examining the gas mixture. The disclosure also relates to the use of such a mass spectrometer and a method for mass spectrometric examination of a gas mixture.

26 Claims, 4 Drawing Sheets

(51) Int. Cl.
*H01J 49/00* (2006.01)
*H01J 49/10* (2006.01)

(56) References Cited

U.S. PATENT DOCUMENTS

| | | | | |
|---|---|---|---|---|
| 5,625,184 | A * | 4/1997 | Vestal | H01J 49/403 250/282 |
| 6,555,814 | B1 | 4/2003 | Baykut et al. | |
| 7,095,019 | B1 | 8/2006 | Sheehan et al. | |
| 7,189,967 | B1 * | 3/2007 | Whitehouse | H01J 49/063 250/292 |
| 7,465,919 | B1 | 12/2008 | Hosea et al. | |
| 7,696,475 | B2 | 4/2010 | Shiea et al. | |
| 8,178,833 | B2 | 5/2012 | Willoughby et al. | |
| 2002/0175292 | A1 * | 11/2002 | Whitehouse | H01J 49/401 250/394 |
| 2007/0224697 | A1 | 9/2007 | Park | |
| 2008/0156984 | A1 | 7/2008 | Makarov et al. | |
| 2008/0191130 | A1 | 8/2008 | Bateman et al. | |
| 2008/0296493 | A1 | 12/2008 | Willoughby et al. | |
| 2009/0057553 | A1 | 3/2009 | Goodenowe | |
| 2009/0166527 | A1 | 7/2009 | Makarov et al. | |
| 2009/0179161 | A1 | 7/2009 | Ward et al. | |
| 2010/0084549 | A1 | 4/2010 | Ermakov et al. | |
| 2010/0123075 | A1 * | 5/2010 | Dantus | H01J 49/0059 250/282 |
| 2011/0114835 | A1 | 5/2011 | Chen et al. | |
| 2011/0186727 | A1 * | 8/2011 | Loboda | H01J 49/0027 250/282 |
| 2011/0211179 | A1 | 9/2011 | Kraus et al. | |
| 2012/0112056 | A1 | 5/2012 | Brucker et al. | |
| 2012/0175515 | A1 | 7/2012 | Hori et al. | |
| 2012/0292495 | A1 | 11/2012 | Hashimoto et al. | |
| 2012/0292498 | A1 * | 11/2012 | Jiang | H01J 49/004 250/282 |

FOREIGN PATENT DOCUMENTS

| | | | |
|---|---|---|---|
| DE | 11 2007 000 921 | T5 | 2/2009 |
| DE | 10 2008 041 592 | A1 | 3/2010 |
| DE | 102008041592 | A1 | 3/2010 |
| EP | 0 575 777 | A2 | 12/1993 |
| EP | 0575777 | A2 | 12/1993 |
| JP | 2008-507108 | | 3/2008 |
| JP | 2009-508307 | | 2/2009 |
| JP | 2011-038797 | | 2/2011 |
| JP | 2011-138650 | | 7/2011 |
| JP | 2012-501072 | | 1/2012 |
| JP | 2012-98293 | | 5/2012 |
| JP | 2012-99487 | | 5/2012 |
| JP | 2012-526362 | | 10/2012 |
| TW | 1271771 | | 1/2007 |
| TW | 200937487 | | 9/2009 |
| WO | WO 02/00962 | | 1/2002 |
| WO | WO 2007/122378 | A2 | 11/2007 |
| WO | WO 2009/048739 | A2 | 4/2009 |
| WO | WO 2009048739 | A2 | 4/2009 |
| WO | WO 2010/022815 | | 3/2010 |

OTHER PUBLICATIONS

International Preliminary Report on Patentability for corresponding PCT Appl. No. PCT/EP2014/053361, dated Jan. 12, 2016.

Glenn et al., "Simulations and Experimental Investigation of Atmospheric Transport in an Ambient Metastable-Induced Chemical Ionization Source," Analytical Chemistry, vol. 81, No. 1, Jan. 1, 2009, pp. 322-329.

Wang et al., "Extension of Dynamic Range in Fourier Transform Ion Cyclotron Resonance Mass Spectrometry via Stored Waveform Inverse Fourier Transform Excitation," *Anal. Chem.* Dec. 1986, 58, 2935.

International Search Report and Written Opinion for corresponding PCT Appl. No. PCT/EP2014/053361, dated Aug. 5, 2014.

German Office Action, with translation thereof, for corresponding DE Appl No. 10 2013 213 501.7, dated Jan. 29, 2014.

Japanese Office Action, with translation thereof, for corresponding JP Appl No. 2016-524707, dated Sep. 12, 2017.

Japanese Office Action, with translation thereof, for corresponding Appl No. 2016-524707, dated Aug. 6, 2018.

European Office Action, with translation thereof, for corresponding EP Appl. No. 14706019.8, dated Jan. 15, 2019.

Watson et al., "Introduction to Mass Spectrometry: Instrumentation, Applications, and Strategies for Data Interpretation," Fourth Edition, John Wiley & Sons, 2007.

* cited by examiner

MASS SPECTROMETER, USE THEREOF, AND METHOD FOR THE MASS SPECTROMETRIC EXAMINATION OF A GAS MIXTURE

CROSS-REFERENCE TO RELATED APPLICATIONS

The present application is a continuation of, and claims benefit under 35 USC 120 to, international application PCT/EP2014/053361, filed Feb. 20, 2014, which claims benefit under 35 USC 119 of German Application No. 10 2013 213 501.7, filed Jul. 10, 2013. The entire disclosure of international application PCT/EP2014/053361 is incorporated by reference herein.

FIELD

The disclosure relates to a mass spectrometer for mass spectrometric examination of gas mixtures, including: an ionization device and an ion trap for storage and mass spectrometric examination of the gas mixture. The disclosure also relates to the use of such a mass spectrometer and a method for mass spectrometric examination of a gas mixture.

BACKGROUND

A mass spectrometer which is used to analyze a residual gas in a EUV lithography apparatus and which has an ion trap for storing the at least one contaminating substance is known from WO 2010/022815 A1.

Mass spectrometry is used not only in EUV lithography but also in many further fields, for example for characterizing chemical compounds in medical chemistry, for identifying substances in bodily fluids or organs, in forensic examinations, doping tests or military analysis of chemical weapons, etc. It is also used for residual gas analysis in pharmacokinetics and in vacuum technology.

In the mass spectrometric examination of gaseous substances or gas mixtures, the mass, more precisely the mass-to-charge ratio, of atoms or molecules is determined in order to obtain a chemical characterization of the gaseous substances. The substances to be examined or the substance mixture to be examined is either already available in the gaseous phase or is converted to the gaseous phase in order to be ionized via an ionization unit. In conventional mass spectrometers, the substances ionized in this manner are supplied to an analyzer and are typically guided through an electric and/or magnetic field, in which the ions describe characteristic trajectories due to different charge-to-mass ratios and it is therefore possible to distinguish between them.

Due to the disadvantages of currently available mass spectrometers, such as large dimensions, slow scanning measurement, no particularly high sensitivity, etc., some known mass spectrometers can only be used to restricted extent, or even not at all, in many applications.

By way of example, the stability of a measurement signal from a gas analyzer or mass spectrometer depends strongly on the temporal stability of the ionization. Conventional quadrupole mass spectrometers generally operate using hot-filament ionization and typically have an inaccuracy of approximately 10%-20%. Alternative types of ionization, such as e.g. plasma ionization, which can likewise be used in mass spectrometry, generally have an inaccuracy in the region of 5%-10% due to inaccuracies in the plasma gas regulation and/or fluctuations in the plasma power.

The time-dependent fluctuations during the ionization lead to a proportional variation in the measurement signals, which entails a corresponding inaccuracy of the measurement. This inaccuracy is particularly disadvantageous if the gas analyzer or the mass spectrometer is intended to be used for quantitative measurements and/or for monitoring and/or examining gas-phase processes in the semiconductor industry or in the chemical industry.

Moreover, during measurements in many conventional mass spectrometers, such as e.g. quadrupole mass spectrometers, the masses are scanned in succession, leading to a long measurement time which, in the case of a high-resolution measurement, can lie in the region of a plurality of minutes, and even in the region of a plurality of hours.

In order to be able to detect a small amount of analytes, i.e. gas constituents to be detected, in a residual gas or process gas under high pressure, there is a need for a large dynamic range. In general, conventional mass spectrometers only enable a dynamic range (ratio of maximum measurable signal to minimum measurable signal) of approximately $10^6$ to at most $10^7$.

In order to detect a small amount of analytes in a residual gas, it is desirable for the mass spectrometer to have a very low detection limit. Currently available mass spectrometers achieve a detection limit of $10^{-13}$ mbar to $10^{-14}$ mbar. For the sensitive detection, use is often made of charge multipliers, which have a large amount of scattering of more than 20% and moreover typically cannot be used at relatively high pressure ($>10^{-4}$ mbar).

Moreover, mass spectrometers are used for different application cases with different pressure ranges of the analyte and/or the background gas. Commercial mass spectrometers are typically designed for one pressure range or the other, but there are no mass spectrometers which cover a very large pressure range without a complicated pressure-specific reconfiguration having to be undertaken for this purpose.

SUMMARY

The disclosure seeks to provide a mass spectrometer and a method which simplify the examination of gases or gas mixtures and, in particular, overcome at least one of the disadvantages set forth at the outset such that the mass spectrometer can also be used in fields of applications in which such use was not possible up until now or only possible with great difficulties.

According to a first aspect, the disclosure provides a mass spectrometer of the type set forth at the outset, in which the ionization device is embodied for supplying ions and/or metastable particles of an ionization gas and/or for supplying electrons to the ion trap for ionizing the gas mixture to be examined, wherein the mass spectrometer (or a control device provided there) is embodied or programmed to determine the number of ions and/or metastable particles of the ionization gas present in the ion trap and/or the number of ions of a residual gas present in the ion trap prior to examining the gas mixture.

According to this aspect of the disclosure, it is proposed to ionize the gas mixture in the measurement cell, which can be embodied as an ion trap or can contain an ion trap. In this case, the gas mixture to be examined is typically supplied to the ion trap or the measurement cell in the form of a gas flow or a gas pulse in the non-ionized state and the ionization preferably is performed directly in the ion trap (in situ); to be precise, in a typical manner, by an impact ionization or charge exchange ionization of the gas mixture with the ions and/or metastable particles of the ionization gas or with the electrons. The ionization can optionally be performed in the measurement chamber outside of the ion trap. In this case, the ionization preferably takes place in the direct vicinity of the ion trap and there is an ion transport of the ionized gas mixture into the ion trap.

Here, an inlet for supplying the gas mixture to be examined into the ion trap can be arranged lying opposite to an inlet for supplying the ions and/or the metastable particles of the ionization gas, or the electrons, such that a gas flow of the supplied gas mixture and particle beam from the ions or metastable particles of the ionization gas and/or the electrons are aligned facing one another and impact on one another in the ion trap or, optionally, in the direct vicinity of the ion trap.

As described further above, the gas mixture to be examined can be ionized by electrons, ions of the ionization gas and/or by metastable particles of the ionization gas. Metastable particles are understood to mean atoms or molecules of the ionization gas, which are electrically neutral but are in an excited (high energy) electron state. In the present case, the gas mixture to be examined is understood to mean mixtures of gaseous substances, which, optionally, may also contain particles, i.e. gaseous substances with a mass number (amu—atomic mass unit)>100 amu, optionally >1000 amu or >10,000 amu, even up to 2,000,000, i.e. particles which can have a macromolecular structure with particle sizes of approximately 0.001 μm-10 μm or more.

Typically, a 3D ion trap, such as e.g. a Paul ion trap, is used as an ion trap for the mass spectrometer; here, the gaseous constituent to be examined or the gas mixture to be examined is trapped in all three spatial dimensions such that the latter performs stable oscillations in all three spatial dimensions and is therefore available for measurement for a relatively long time (typically 1 ms or more, preferably less than 1 second or 100 ms). The dimensions of the space in which the ionized gas constituent(s) is/are trapped typically are less than 50 cm×50 cm×50 cm, preferably less than 50 mm×50 mm×50 mm.

The mass spectrometer preferably has a controllable inlet for pulsed supply of the gas mixture to be examined to the ion trap and the mass spectrometer is embodied or programmed to determine the particle number of constituents to be examined or of ion populations (at a given mass-to-charge ratio) of the ionized gas mixture in the mass spectrometer, taking into account the determined number of ions and/or metastable particles of the ionization gas and/or the number of ions of the residual gas. The determined number of primary ions (i.e. ions of the ionization gas and residual gas) or metastable particles of the ionization gas serves for the calibration during the measurement or detection in order to minimize the influence of time-dependent fluctuations in the number of primary ions or metastable particles of the ionization gas provided for the ionization or in the number of ions of the residual gas. In the case of pulsed operation of the ion trap, there can, to this end, be a calibration before supplying a respective gas pulse by virtue of the determined number of ions and/or metastable particles, which are available for ionizing a respective gas pulse of the gas mixture, being taken into account when determining the particle number of ionized constituents, to be examined, of the gas pulse of the gas mixture to be examined. By way of example, the determined number of ions or metastable particles can be taken into account when determining the particle number by virtue of the number thereof being included in a proportionality constant (correction factor), by which the result of the measurement (i.e. the measured signal level) is multiplied in order to correct the measured particle number of the ionized constituents of the gas mixture to be examined.

In general, the ion trap is connected to a chamber, e.g. a process chamber, via a controllable inlet, for example in the form of a controllable valve, in which chamber the gas mixture to be examined is contained. The controllable inlet is synchronized to the operation of the ion trap, which is generally embodied as an FTIT (Fourier Transform Ion Trap). Accordingly, the ionization device can also have a controllable inlet for, in particular, pulsed supply of the ions or metastable particles of the ionization gas and/or the electrons.

In order to detect the gas mixture to be examined, the electrons or ions and/or metastable particles of the ionization gas is/are initially injected into the ion trap, with there typically being an ionization of a residual gas present there. The produced residual gas ions and the ions of the ionization gas (referred to together as primary ions below) are trapped by the ion trap or stored there. The primary ions are now excited by an alternating electric signal such that the primary ions perform a closed three-dimensional movement (rollercoaster movement). The rollercoaster movement induces an image current on the cover electrodes or measurement electrodes of the ion trap, from the magnitude of which the number of primary ions in the ion trap can be determined with an accuracy of less than 5%. Within the meaning of this application, the number of primary ions is also understood to mean a value which is proportional to the number of primary ions.

Alternatively, or in addition thereto, it is also possible to determine the number of (neutral) metastable particles of the ionization gas in the ion trap, for example by determining the prevalent pressure in the ion trap, e.g. by the temporal decrease (time constant) of the ion transients, i.e. of the image current on the measurement electrodes, since this is directly dependent on the mean free path length and hence on the pressure. The pressure in the ion trap is substantially determined by the ionization gas, e.g. helium, introduced into the ion trap for ionization purposes such that, from this, it is possible to determine the actual number of metastable particles present in the ion trap, since the number of ions of the ionization gas can likewise be determined by the magnitude of the image currents (see above). If the ionization gas predominantly consists of metastable particles, it is optionally also possible to dispense with determining the number of ions of the ionization gas (and vice versa). The number of metastable particles in the residual gas can be neglected in this case due to the typically significantly lower pressure (generally approximately 3-4 orders of magnitude) of the residual gas, e.g. water. A further option for determining the number of metastable particle consists of determining the number of particles of the residual gas (e.g. water), situated in the ion trap, which were ionized by the metastable particles of the ionization gas, in order to determine indirectly therefrom the number of metastable particles which have led to the ionization of the residual gas.

In the manner described above, so to say, the background noise during the subsequent examination of the gas mixture in the ion trap is determined. After measuring the background noise, the controllable gas inlet is opened and the gas or gas mixture to be examined is introduced into the measurement chamber (or into the ion trap) from the chamber in the form of a gas pulse. The gas pulse enters the ion trap through an opening in the ion trap and is ionized there via a charge exchange process or by impact ionization with the electrons and/or primary ions or metastable particles, and kept trapped in the ion trap for the mass spectrometric examination.

After the ionization of the gas mixture to be examined, the ions or the ionized constituents of the gas mixture to be examined are excited by an electric impulse signal (excitation signal). In the process, the ions of the gas mixture to be examined are brought into a rollercoaster movement, wherein each mass-to-charge ratio (m/z) has a different rollercoaster frequency. As in the case of the primary ions, these rollercoaster movements produce an image current on the cover electrodes or measurement electrodes. A Fourier transform can be applied to this measurement signal assigned to the ions, wherein each Fourier frequency can be assigned to one mass-to-charge ratio m/z and the signal level (Hf) assigned to each frequency is directly proportional to the ion number or the particle number of the respective ion population of the ionized constituent to be examined at the corresponding mass-to-charge ratio m/z.

In order to minimize the influence of the time fluctuations during the ionization by the primary ions or metastable particles, the following procedure can be adopted: the particle number or the signal level Hf for each frequency for each mass-to-charge ratio m/z is determined or corrected by the following equation:

$$Hf(\text{corrected})=K*Hf(\text{uncorrected})*H1/\Sigma Hf, \quad (1)$$

where K denotes a correction factor independent of mass and frequency, H1 denotes the signal level of all ions stably stored and excited in the ion trap, Hf (uncorrected) denotes the spectral level or signal level of the ion of interest or of the ionized constituent to be examined and Σ Hf denotes the sum of all signal levels of the spectral lines present in the measured spectrum. The correction factor K takes into account the number of ions of the ionization gas and/or of the residual gas and of the metastable particles of the ionization gas, determined in the manner described above, and is typically recalculated for each gas pulse in order to eliminate or reduce the influence of fluctuations of the ions or metastable particles available for the ionization of the gas mixture to be examined on the measurement of a plurality of gas pulses. Here, the spectral lines of the measured spectrum can be restricted to the mass-to-charge ratios m/z which lie outside of the spectrum of the ions of the ionization gas or residual gas, but this is not mandatory.

The mass spectrometer is preferably embodied or programmed to produce an excitation of the ions of the gas mixture, without exciting the ions of the ionization gas and/or the residual gas, for determining the particle number of ionized constituents of the gas mixture to be examined. To this end, an excitation signal (electric impulse signal) of the ion trap is selected in such a way that, after ionizing the gas mixture to be examined, all ions bar the primary ions are excited. By way of example, it is possible to configure this excitation signal in such a way that the primary ions in the ion trap become unstable and consequently leave the ion trap such that only the ions of the gas mixture to be examined are still excited and remain in the trap.

In a further embodiment, the mass spectrometer is embodied to determine the number of ions of a constituent of the ionized gas mixture to be examined, in the ion trap, with an imprecision of less than 5%. The measurement sequence further described above, including determining the primary ion number, can theoretically be repeated any number of times. Since there is normalization in advance to the primary ion number H1 in each measurement procedure and since the conversion as per Equation (1) for determining the corrected measurement signal is used in each measurement sequence, it is possible, in theory, to completely eliminate the time fluctuations due to the variation or drift in the ionization.

In a further aspect of the disclosure which, in particular, can also be realized in combination with the above-described aspect, the ionization gas is a metastable noble gas, in particular helium. In order to accelerate the measurement, attempts are made in the prior art to collect the ions as quickly as possible in the centre of the ion trap by gas braking. By way of example, US 2010/0084549 A1 describes that a buffer gas can be introduced into the ion trap during the operation in order to cool the ions and focus these in the centre of the ion trap. However, this results in a substantial deterioration of the mass resolution in an in-situ measurement (i.e. in the case of a measurement in the ion trap) which is why the ion detection is typically carried out outside of the ion trap in the prior art.

In order to achieve an unchanging, high mass resolution without in the process waiting for too long due to the deliberate low working pressure in the ion trap, the present aspect of the disclosure proposes that the mass spectrometer is embodied for supplying metastable particles to the ion trap of an ionization gas in the form of a metastable noble gas. Metastable noble gas particles are neutral particles in an excited electron state (just before the actual ionization). As a result, the metastable particles obtain a particularly large cross section, resulting in a larger impact probability in the ion trap with the constituents of the gas mixture to be examined. As a result, the ions to be examined are collected more quickly in the centre of the ion trap, without higher pressure as a result of a buffer gas being involved for this purpose, and so measurements can be carried out significantly more quickly than in already known solutions. Helium, in particular, was found to be advantageous as metastable noble gas. However, in addition to noble gases such as He, Ar, Kr and Xe, it is also possible to make use of e.g. hydrogen ($H_2$), nitrogen ($N_2$) or mixtures of same as ionization gas. These gases can also be introduced into the ion trap as metastable particles in order to collect the gas mixture to be examined in the centre of the trap.

In one development, the mass spectrometer is embodied to record at least 10 spectra/s with a mass bandwidth of in each case at least 500 amu or 1000 amu. As was explained further above, the use of metastable particles can increase the cross section or the impact probability of the ionization gas with the gas mixture to the examined or with the gas constituents to be examined, and consequently increases the speed of the measurement to the values mentioned above.

In a further embodiment, the ionization device has a plasma source for producing ions and/or the metastable particles of the ionization gas, in order to supply these to the ion trap. By way of example, the ionization gas can be ionized by a plasma source, which converts the gas constituents of the ionization gas into a metastable electron state or ionizes these. By way of example, in the process, noble gases, e.g. helium atoms, can be converted into a metastable state or be ionized. The ratio between the portion of gas molecules of the ionization gas converted into ions and the portion converted into metastable particles can be influenced by a plasma source with a suitable design or by a suitable process control, for example by the plasma power and the gas flow of the ionization gas.

It was found to be advantageous if the plasma and hence the ions or the metastable particles of the ionization gas are generated in a plasma source outside of the ion trap, i.e. if the plasma production in the plasma source and the ionization of the gas mixture to be examined (by impact ionization or charge exchange ionization) in the ion trap are performed in a spatially separated manner because this can significantly reduce the temperature increase caused by the plasma in the ion trap.

The plasma source can be embodied as radiofrequency plasma source, medium frequency plasma source, DC plasma source, dielectric barrier discharge plasma source, atmospheric pressure plasma source, corona discharge plasma source, etc.

In an advantageous development, the plasma source is embodied for producing ions and/or metastable particles of the ionization gas at a temperature of less than 100° C., i.e. the plasma discharge in the plasma source occurs at a low temperature (under 100° C.). By way of example, this can be achieved by applying an alternating radiofrequency field (with frequencies between 1 MHz and 30 MHz) since a corresponding RF discharge can advantageously occur at temperatures between 10° C. and 200° C. It is understood that, in place of a plasma source, use can also be made of a different type of ionization device which is able to convert or ionize the (neutral) ionization gas into an excited electron state in order to bring about an impact or charge exchange ionization of the gas mixture in the ion trap. A particularly sparing (cold) ionization with a small fragmentation of the analyte can be achieved, in particular, by a charge exchange between the analyte and the metastable noble gas particle.

As a result of the little fragmentation of the analyte, there can also be a particle measurement and characterization of large particles with mass numbers up to 2,000,000 amu in the ion trap. To this end, it is possible to make use of the fact that the mass-to-charge ratio m/z to be detected depends as follows on the storage amplitude $V_{rf}$ (trajectory diameter) and the field frequency $f_{rf}$ in the ion trap:

$$m/z \sim V_{rf}/(f_{rf})^2.$$

Consequently, it is possible to measure particles with a very large mass by increasing the storage amplitude $V_{rf}$ and/or by reducing the field frequency $f_{rf}$ in the ion trap.

In a further embodiment, the ionization device has an electron beam source for producing the electrons. In particular, the electron beam source can be embodied to produce electrons with a variable electron energy, for example in the range between 1 eV and 100 eV. The electron beam source, e.g. in the form of an electron gun, can also be equipped with a focusing device or with a beam guidance in order to align the electrons onto the gas flow of the gas mixture to be examined. The electron beam source can be used as an alternative or in addition to the plasma source for ionizing the gas mixture.

A further aspect of the disclosure which, in particular, can also be combined with one of the preceding aspects is realized in a mass spectrometer of the type set forth at the outset, which is embodied to selectively remove or suppress ions with a mass-to-charge ratio from the ion trap, the number of which ions in the ion trap exceeds a predefined threshold. In order to increase the dynamic range of the mass spectrometer, it is proposed to suppress large ion populations or remove these from the ion trap such that specific subsets of ion populations can be measured more precisely.

By way of example, in a "Fourier Transform Ion Cyclotron Resonance" (FT-ICR) trap, the ion populations can be removed or suppressed by the so-called SWIFT (Stored Waveform Inverse Fourier Transform) excitation as is described e.g. in the article "Extension of Dynamic Range in Fourier Transform Ion Cyclotron Resonance Mass Spectrometry via Stored Waveform Inverse Fourier Transform Excitation" by Tan-Chin Lin Wang et al., Anal. Chem. 1986, 58, 2935-2938. Here, a simultaneous measurement can be performed, in particular in a plurality of measurement regions with different mass-to-charge ratios.

The dynamic range can also be increased in a further aspect of the disclosure which, in particular, can be combined with one or more of the above-described aspects and in which a mass spectrometer of the type set forth at the outset is embodied to selectively detect ions or ionized constituents of the gas mixture to be examined in predefined measurement ranges of the mass-to-charge ratio. This enables a mass-selective time multiplex measurement to be realized, which likewise renders it possible to increase the dynamic range.

It is also possible to use further, more complex measurement modes (e.g. any combination of the two above-described processes (SWIFT or time multiplexing)) in order to increase the dynamics. Here, care always has to be taken that the measurement device is not overdriven.

In one development, the mass spectrometer has a dynamic range of $10^8$ (or $10^8$: 1) or more. Such a dynamic range can be achieved by the use of a measurement method or a combination of the two above-described measurement methods.

In one development, the ion trap is embodied to accumulate individual ions of the gas mixture and the mass spectrometer has a detection limit of $10^{-15}$ mbar or less (i.e. $<10^{-15}$ mbar). Ion trap mass spectrometers generally operate discontinuously, i.e. an analysis of the ion number can occur after a predefined accumulation time (for example less than 100 ms). In particular, it is possible, optionally, to use an ion trap to undertake both an accumulation of the gas constituent to be detected and a separation of the gas constituent to be detected from further gaseous constituents.

By combining the above-described processes for increasing the dynamic response (SWIFT or time multiplex measurement) with the accumulation capability of the ion trap, it is possible to detect particularly small/weak ion populations. In the process, individual ions can be accumulated until a sufficiently large measurement signal is present. In the case of a known measurement signal and a known accumulation time, the ion population to be examined can be determined quantitatively. In this manner, the detection limit of the mass spectrometer can be lowered to $10^{-15}$ mbar or less.

A further aspect of the disclosure which, in particular, can be combined with one of the preceding aspects is realized by a mass spectrometer which has a pressure reduction unit with at least one, preferably at least two, in particular three or more modular pressure stages, which can be connected in series, for reducing the gas pressure of the gas mixture to be examined. In accordance with this aspect, it is proposed to realize a pressure reduction unit with a modular design of one, two or three (or optionally more) pressure stages which can be attached between a measurement chamber (typically with an ion trap, optionally also with a conventional mass spectrometer, e.g. a quadrupole mass spectrometer) and the chamber with the gas mixture to be examined. Depending on the application, this renders it possible to connect one, two or three pressure stages in series in order to reduce the gas pressure so far that the gas mixture can be supplied to the measurement chamber. In the case where the gas pressure in the chamber with the gas mixture to be examined is low enough (e.g. $<10^{-5}$ mbar), it is optionally possible to dispense with a pressure reduction unit, i.e. no pressure stage is required or introduced between the chamber with the gas mixture to be examined and the measurement chamber.

By way of example, the pressure reduction unit can consist of three (or more) pressure stages coordinated with one another, wherein the coordination can be realized by a pressure reduction of approximately 100-1000 mbar in each pressure stage. It is possible to use all three pressure stages in the case of a high gas pressure of the gas mixture to be examined (100 bar-$10^{-2}$ mbar), it is possible to use two of the pressure stages in the case of a medium pressure ($10^{-2}$ mbar-$10^{-5}$ mbar) of the gas mixture and it is possible to use only one pressure stage in the case of a low gas pressure ($<10^{-5}$ mbar). Optionally, it is possible to dispense with the provision of a pressure stage in the case of pressure in the chamber with the gas mixture to be examined is at $10^{-5}$ mbar or below. The pressure stages have a modular design and can be connected in series by virtue of these being attached to one another, for example by virtue of these being screwed to one another in a gas tight manner on flanges. In this manner, it is possible to disassemble or reassemble the pressure stages very quickly in order to serve the desired pressure range of the gas mixture to be detected.

By using one or more pressure stages or by using no pressure stage, it is possible to use the mass spectrometer for examining gas mixtures with a gas pressure of between $10^{-5}$ mbar and $10^{-15}$ mbar and it can, in particular, be adapted to the desired pressure range in a particularly simple manner.

A further aspect of the disclosure which, in particular, can be combined with one of the preceding aspects is realized in a mass spectrometer which is embodied to repeatedly excite ionized constituents of the gas mixture to be examined in the ion trap and to record a mass spectrum of the ionized constituents to be examined during a predetermined time duration in the case of each excitation. In accordance with this aspect, it is proposed to make use of the option of ion trap mass spectrometers to carry out multiple repetitions of the ion excitation without having to use a further component for this purpose. It is possible to detect the ionized constituents to be examined or record a mass spectrum during each excitation.

In one development, the time duration for recording a mass spectrum is at 5 ms or less. Since the constituents of the gas mixture to be examined only have to be excited but not re-ionized, it is possible to record a mass spectrum very quickly by virtue of the corresponding measurement window for determining the mass spectrum being displaced or synchronized with the excitation of the ionized constituents. This renders it possible to measure the analyte molecules during a chemical reaction, before these react with one another, or it is possible to detect intermediate products such that the reaction dynamic response can be detected by shifting the measurement window and the chemical reaction process can be imaged in real time.

In a further embodiment, the ion trap is selected from the group including: Fourier transform ion trap, in particular Fourier transform ion cyclotron resonance trap, Penning trap, toroidal trap, Paul trap, linear trap, orbitrap, EBIT and RF buncher. The ion trap is preferably embodied for detecting the ions stored or accumulated in the ion trap, in particular by using a Fourier transform.

The use of such an ion trap, for example an FT ion trap, enables the implementation of quick measurements (with scan times in the second range or faster, e.g. in the millisecond range). In this type of trap, the induction current, which is generated by the trapped ions on the measurement electrodes, is detected and amplified in a time-dependent manner. Subsequently, this time dependence is transformed into the frequency space by a frequency transform, such as e.g. a Fast Fourier Transform, and the mass dependence of the resonant frequencies of the ions is used to convert the frequency spectrum into a mass spectrum. Mass spectrometry via a Fourier transform can be carried out to carry out fast measurements, in principle with different types of ion traps (e.g. with the above-described types), wherein the combination with the so-called ion cyclotron resonance trap is the most common. The FT-ICR trap constitutes a development of the Penning trap, in which the ions are enclosed in alternating electric fields and a static magnetic field. In the FT-ICR trap (magnetic or electric ICR trap), mass spectrometry can be operated via cyclotron resonance excitation. In a development of this, the Penning trap can also be operated with an additional buffer gas, wherein a mass selection by spatial separation of the ions can be generated by the buffer gas in combination with a magnetron excitation via an electric dipole field and a cyclotron excitation via an electric quadrupole field, such that the Penning trap can also be used for separating the substance to be detected from other substances. Since the buffer gas in this type of trap generally has a movement-damping and hence "cooling" effect on the enclosed ions, this type of trap is also referred to as "cooling trap".

The so-called toroidal trap enables a more compact design compared to a conventional quadrupole trap, while substantially having an identical ion storage capacity. The linear trap is a development of the quadrupole trap or Paul trap, in which the ions are not held in a three-dimensional quadrupole field but rather in a two-dimensional quadrupole field via an additional edge field, in order to increase the storage capacity of the ion trap. The so-called orbitrap has a central, spindle-like electrode, about which the ions are kept on orbitals as a result of the electric attraction, wherein an oscillation along the axis of the central electrode is produced by an off-centre injection of the ions, which oscillation generates signals in the detector plates, which signals can be detected like in the case of the FT-ICR trap (by FT). An EBIT (electron beam ion trap) is an ion trap, in which the ions are produced by impact ionization via an ion gun, wherein the ions produced thus are attracted by the electromagnetic field and trapped by the latter. The ions can also be stored in an RF (radiofrequency) buncher, for example a so-called RFQ (quadrupole) buncher. It is understood that, in addition to the above-listed types of traps, it is also possible to use other types of ion traps for gas analysis, which other types of traps can be optionally combined with an evaluation using a Fourier transform.

The above-described mass spectrometer on the basis of an ion trap (in particular with plasma ionization) can be used for detecting the smallest amounts of trace elements in different fields:

By way of example, the mass spectrometer can be used for the mass spectrometric examination of a gas mixture in EUV lithography. In this use, it is possible, in particular, to analyze the residual gas contained in an EUV lithography system, e.g. in an EUV lithography apparatus, for example in view of contaminating substances contained therein. The use of the mass spectrometer in EUV lithography is enabled or promoted by the following of the features listed further above:

- Quantitative measurement with continuous, highly precise online in-situ calibration (inaccuracy less than 5%) for determining how many ions are present in the ion trap at a specific peak (mass-to-charge ratio),
- High dynamic range: up to $10^8$ or more (ratio between most intensive and weakest signal),
- Low detection limit: down to $10^{-15}$ mbar, Pressure range of the medium to be examined: $10^{-15}$ mbar-$10^{3}$ mbar with an unchanging detection limit, An electron impact ionization, cold ionization via plasma ionization or ionization via metastable particles with low fragmentation, single ionization at low temperature (<100° C.).

By way of example, when using the mass spectrometer in an EUV lithography apparatus, a connection position of the mass spectrometer in a projection system of the EUV lithography apparatus can be formed at a distance of less than 50 cm from at least one mirror of the projection system, a connection position in an illumination system of the EUV lithography apparatus can be formed at a distance of less than 50 cm from at least one mirror of the illumination system or a connection position in a radiation generating system of the EUV lithography apparatus can be formed at a distance of less than 1 m, preferably of less than 50 cm from a collector (mirror), an EUV light source or an opening for the passage of EUV radiation from the radiation generating system into the illumination system.

It is advantageous if the connection position of the mass spectrometer, which is defined by an opening in the wall of a vacuum housing, typically of the projection system, of the illumination system or of the radiation generating system, through which the substances to be examined can enter into the mass spectrometer, is formed in the vicinity of a mirror of the EUV lithography apparatus in order to be able to detect contaminating substances, which can possibly accumulate on the optical surface of the mirror, in a targeted manner.

The arrangement of the mass spectrometer at a connection position in the vicinity of an opening between the radiation generating system and the illumination system is advantageous for being able to determine the size of the proportion of contaminating substances passing from the radiation generating system into the illumination system. The arrangement of the mass spectrometer at a connection position in the vicinity of the EUV light source renders it possible to detect or measure contaminating substances produced by the EUV light source.

In a development, the mass spectrometer is separated from a housing of the EUV lithography apparatus, containing a residual gas atmosphere and guiding the EUV radiation, by a vacuum connection, the vacuum connection having a cross section of less than 100 mm, preferably of less than 5 mm, in particular of less than 1 mm or less than 500 μm and typically of more than 50 μm. For the mass spectrometric examination, it is advantageous if the cross section of the vacuum connection between the mass spectrometer and a housing of the projection system, of the illumination system, of the radiation generating system or of a vacuum housing surrounding these is not selected to be too large. In particular, such a vacuum connection allows the interior of the mass spectrometer to be evacuated via a vacuum pump or a vacuum generation device, which only or predominantly evacuates the interior of the mass spectrometer.

In a further development, at least one of the following contaminating substances or the mixtures thereof is/are measured or detected during the mass spectrometric examination in the case of a residual gas atmosphere of the EUV lithography apparatus, in particular containing hydrogen and/or helium and/or air: oxygen, ozone, water, $C_XH_YO_Z$ up to 10 Mamu, particles up to 10 Mamu, metal-$C_XH_YO_Z$-compounds up to 10 Mamu, with 1 Mamu=1,000,000 amu.

The disclosure also includes an EUV lithography apparatus which is embodied as the EUV lithography apparatus described above in conjunction with the use of the mass spectrometer.

A further use of the mass spectrometer relates to the mass spectrometric examination of a gas mixture during a coating process in a coating apparatus, which gas mixture can contain e.g. process gases. In particular, the above-described mass spectrometer can have a self-cleaning function in order to remove deposits formed in the measurement chamber or in the ion trap, which deposits are created by the gas mixtures to be examined, in particular the process gases. As a result of the option for self-cleaning, the mass spectrometer can be used in many coating processes. A small installation space (approximately 300 mm high×approximately 300 mm wide and approximately 200-300 mm deep) thereof constitutes a further special feature of the mass spectrometer described here. This enables the use of the mass spectrometer in many applications in which the installation space plays a role (e.g. MOCVD, see below).

By way of example, self-cleaning can occur as illustrated in WO 02/00962 A1, which describes an in-situ cleaning system for removing deposits produced by process gases in a sample chamber of a process monitoring unit in a wafer production apparatus. Deposits which set in over the course of one or more analyses in the sample chamber can, when desired, be removed via a cleaning gas. The cleaning gas forms a gaseous cleaning product with the deposits during the production of a plasma in the sample chamber, which cleaning product is removed from the sample chamber.

In a development of the above use, the coating process is selected from the group including: chemical vapour deposition (CVD), metal organic chemical vapour deposition (MOCVD), metal organic chemical vapour phase epitaxy (MOVPE), plasma enhanced chemical vapour deposition (PECVD), atomic layer deposition (ALD), physical vapour deposition (PVD), (in particular plasma-assisted) etching and implantation processes and molecular beam epitaxy (MBE) processes.

The use of the mass spectrometer in this field of application is enabled or promoted by the following of the features listed further above:

High dynamic range: up to $10^{8}$ or more (ratio between max/min signal),

High scanning speed: up to 10 spectra/s or more, with a mass bandwidth of up to approximately 1000 amu, Low detection limit: down to $10^{-15}$ mbar, Pressure range of the medium to be examined: $10^{-15}$ mbar-$10^{3}$ mbar with an unchanging detection limit, Electron impact ionization or cold ionization via plasma ionization or ionization via metastable particles with low fragmentation, single ionization at low temperature (<100° C.), A suitable fast measurement process (in the millisecond range) renders it possible to image the realistic chemical process in real time, Particle measurement and characterization in the process chamber, Self-cleaning of the mass spectrometer via a suitable cleaning process.

In one development, an inclusion position of the mass spectrometer in the coating apparatus is formed in a gas supply system, in a gas mixing system or in a gas disposal system, in particular upstream or downstream of a vacuum pump of the gas disposal system, and/or at a distance of less than 1 m, preferably of less than 50 cm from a process chamber. In particular, the mass spectrometer can be connected directly to the process chamber. Furthermore, the mass spectrometer, or a further mass spectrometer, can be attached in the gas supply system, in the gas mixing system or in a gas disposal system, in particular in a vacuum line between the process chamber and a vacuum pump, directly upstream of the vacuum pump or in an exhaust-gas line downstream of the vacuum pump. By a suitable selection of an inclusion position, the process can be influenced as desired, i.e. it can, in particular, be controlled or regulated, on the basis of the result of the mass spectrometric examination.

When using the mass spectrometer in a coating apparatus, at least one of the following substances, the mixtures and/or reaction products, clusters and/or compounds thereof can be measured during the mass spectrometric examination: $H_2$, He, $N_2$, $O_2$, $PH_3$, $AsH_3$, B, P, As, $CH_4$, CO, $CO_2$, Ar, $SCl_4$, $SiHCl_3$, $SiH_2Cl_2$, $H_2O$, $C_xH_y$, trimethylgallium, triethylgallium, trimethylaluminium, triethylaluminium, trimethylindium, triethylindium, $Cp_2Mg$, $SiH_4$, $Si_2H_6$, tetrabutylammonium, tetrabutylsilane, Xe isotropes, Kr isotropes, hexamethyldisiloxane, tert-butylarsine, trimethylarsine, diethyl-tert-butylarsine, diethyl-tert-butylphosphine, di-tert-butylphosphine, tert-butylhydrazine, dimethylhydrazine, indium, aluminium, gallium, boron, silicon, gold, antimony, bismuth.

In one development, the at least one substance, the mixture, the reaction product, the cluster and/or the compound is/are measured at a temperature in the process chamber of between 15° C. and 5000° C., preferably between 100° C. and 2000° C., and at the pressure in the process chamber of between $10^{-10}$ mbar and 5 bar, preferably between $10^{-8}$ mbar and 1 bar.

The disclosure also includes a coating apparatus which is embodied as the coating apparatus described above in conjunction with the use of the mass spectrometer.

A further use of the mass spectrometer described above lies in the field of analysis, preparation, treatment, modification and/or manipulation of samples. In this case, the mass spectrometer can serve e.g. for gas and/or residual gas monitoring or for monitoring, analysing and/or regulating a device which serves for the analysis, preparation, treatment, modification and/or manipulation of samples. By way of example, the device can be a multibeam instrument, in which e.g. an electron beam and/or ion beam column, a laser beam, an x-ray beam, photon beam, etc, can be used alternatively in order to prepare, treat, modify and/or manipulate and optionally analyse a sample. The device can also be a device for surface scanning analysis, which can optionally also be integrated into the multibeam instrument.

A further use of the mass spectrometer described above lies in the field of gas analysis in the discipline of chemistry, more precisely in the field of chemical process analysis.

The use of a mass spectrometer in this field of application is enabled or promoted by the following of the features listed further above:

- Quantitative measurement with continuous, highly precise online in-situ calibration (inaccuracy less than 5%) for determining how many ions are present in the ion trap at a specific peak (mass-to-charge ratio),
- High scanning speed: up to 10 spectra/s or more, with a mass bandwidth of up to approximately 1000 amu,
- High dynamic range: up to $10^8$ or more (ratio between max/min signal),
- Low detection limit: down to $10^{-15}$ mbar,
- Pressure range of the medium to be examined: $10^{-15}$ mbar-$10^3$ mbar with an unchanging detection limit,
- Electron impact ionization or cold ionization via plasma ionization or ionization via metastable particles with low fragmentation, single ionization at low temperature (<100° C.),
- A suitable fast measurement process (in the millisecond range) renders it possible to image the realistic chemical process in real time.

A further use of the mass spectrometer described above lies in the field of vibration detection or vibration analysis of, typically, mechanical vibrations. In particular, the mass spectrometer can be used for detecting or analysing vibrations in a range between approximately 1 Hz and approximately 15 kHz. In particular, the vibrations can be natural vibrations of a setup or a device, into which the mass spectrometer is installed, i.e. the vibrations are detected at the point of use of the mass spectrometer and the mass spectrometer is used as vibration sensor. For this purpose, the mass spectrometer is used to record a spectrum within a frequency range in which the vibration frequencies to be analysed lie. By way of example, this frequency spectrum can lie between approximately 1 Hz and approximately 15 kHz. A plurality of parasitic frequencies typically lie within this frequency range, which parasitic frequencies are produced by mechanical vibrations and which can be detected and analyzed by the measurement electrodes of e.g. an FT ion trap, in particular an FT-ICR trap. By way of example, in order to analyze the vibrations, a frequency spectrum can be recorded as soon as the mass spectrometer is installed into the device. If the device was in good working order at the time of the installation, this frequency spectrum can serve as reference spectrum. Measuring the frequency spectrum can be repeated at a later time or at several later times, and the measured frequency spectrum can be compared to the reference spectrum. If one or more additional lines or peaks are detected in the measured frequency spectrum, this is an indication that undesired vibrations are occurring somewhere in the device, which e.g. can be traced back to mechanical problems. By way of example, the vibrations can be undesired natural vibrations of sliding bearings or ball bearings, e.g. of (vacuum) pumps, which are arranged in the vicinity of the mass spectrometer, or vibrations caused by a power supply unit (mains hum).

It is understood that the use of the above-described mass spectrometer is not restricted to the fields of use described above, but that the mass spectrometer also can be used advantageously in other fields of use.

The disclosure also relates to a method for mass spectrometric examination of a gas mixture, including the following method steps: supplying ions and/or metastable particles of an ionization gas and/or electrons to an ion trap, determining the number of ions and/or metastable particles of the ionization gas present in the ion trap and/or determining the number of ions of a residual gas present in the ion trap, supplying the gas mixture to be examined to the ion trap, in particular in a pulsed manner, and determining the particle number (or a signal proportional to the particle number) of ionized constituents of the gas mixture to be examined, taking into account the determined number of ions and/or metastable particles of the ionization gas and/or the number of ions of the residual gas.

As described further above in conjunction with the first aspect of the disclosure, there can be a quantitative analysis of the constituents of the gas mixture to be examined using a continuous highly precise in-situ calibration by virtue of determining the number of primary ions present in the ion trap, and so it is possible to determine the number of ions (corresponding to a peak in the spectrum), which are detected at a specific mass-to-charge ratio, with a high precision. Typically, an inaccuracy of less than 5% is achieved here, i.e. the measured value deviates from the actual number of (ionized) particles of the gas constituent present in the sample volume of the ion trap by no more than 5% (above or below the actual number).

During the method, the following procedure is typically carried out: initially, the primary ions are accumulated in the ion trap. After the accumulation there is the excitation of the primary ions, which is followed by the measurement of the number of primary ions. Additionally, or alternatively, it is possible to determine the number of metastable particles in the ion trap. Provided that the ionization gas is present substantially in the form of metastable particles, the number thereof is proportional to the overall pressure in the ion trap since the pressure of the residual gas can be neglected. By way of example, the overall pressure can be determined with great accuracy by the decrease in time (time constant) of the ion transients. The number of metastable particles of the ionization gas actually present in the ion trap can then be deduced on the basis of the pressure.

While exciting the primary ions and measuring the number of primary ions and/or metastable particles, a gas pulse of the gas mixture to be examined is produced in parallel and the latter moves to the ion trap. Here, the production of the gas pulse is typically synchronized with the measurement of the primary ion number and/or the metastable particle number in such a way that the gas pulse reaches the ion trap at the time (or just after) at which the measurement of the number of the primary ions and/or metastable particles is complete.

The gas mixture transported in the gas pulse is ionized in the ion trap or optionally in the measurement chamber just before entering the ion trap via the primary ions and/or metastable particles or by the electrons by impact ionization and/or charge exchange ionization. In a subsequent step, the ions of the gas mixture are excited. Prior to or during the excitation of the ions of the gas mixture, the primary ions can be removed from or suppressed in the ion trap by virtue of a suitable excitation signal being produced. In a subsequent step, there is a measurement or detection of the excited ions of the gas mixture. In principle, the process specified above can be repeated as often as desired. Since the ions are not converted into neutral particles during the detection, it is also possible to repeatedly excite the ions of the gas mixture in the ion trap after the ionization of the gas mixture, without a new ionization of the gas mixture having to be performed for this purpose.

Further features and advantages of the disclosure emerge from the following description of exemplary embodiments of the disclosure, on the basis of the figures in the drawing, which show features of the disclosure, and from the claims. In each case, the individual features can be realized on their own or together in any combination in a variant of the disclosure.

BRIEF DESCRIPTION OF THE DRAWINGS

Exemplary embodiments are depicted in the schematic drawing and will be explained in the following description. In detail.

DETAILED DESCRIPTION

In the following description of the drawings, identical reference signs are used for the same or functionally equivalent components.

Figure 1:
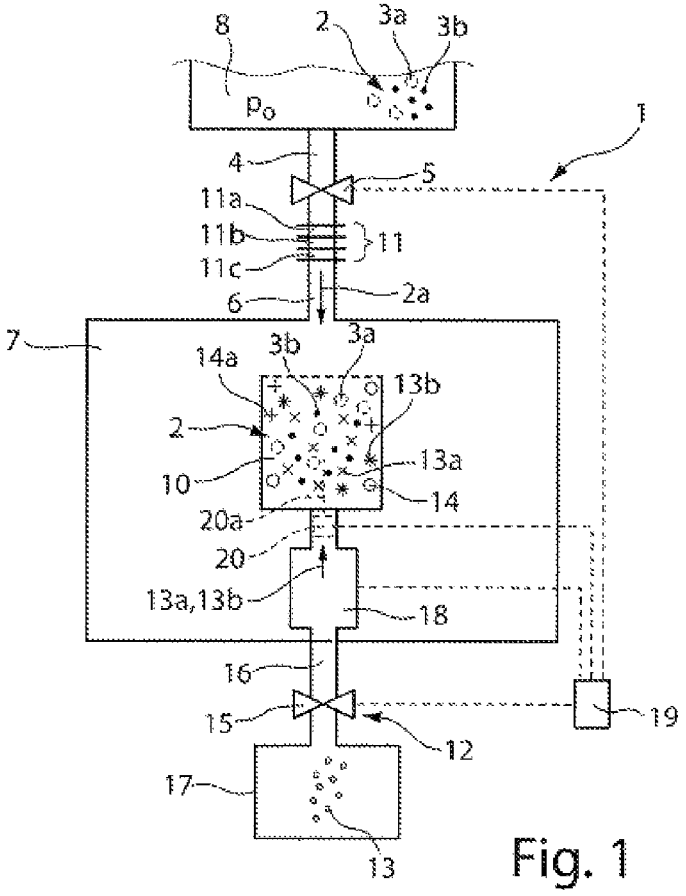
FIG. 1 shows a schematic illustration of a mass spectrometer for mass spectrometric examination of a gas mixture.

FIG. 1 schematically shows a mass spectrometer 1, which is connected to a chamber 8, or can be connected thereto, in which a gas mixture 2 to be examined is arranged. By way of example, the chamber 8, of which only a section is depicted in FIG. 1, can be a process chamber, which forms part of an industrial apparatus in which an industrial process is carried out. Alternatively, the chamber 8 can be e.g. a (vacuum) housing of a lithography apparatus or a different type of chamber, in which the gas mixture 2 to be examined is arranged. In the shown example, the gas mixture 2 has a substance 3*a* present in the gas phase (i.e. a gas) with an atomic mass number <100 and particles 3*b*, the mass number of which lies at 100 or more.

The chamber has an outlet 4, which can be connected to the inlet 6 of a measurement chamber 7 via a controllable valve 5 belonging to the mass spectrometer 1. In the mass spectrometer 1 shown in FIG. 1, the gas mixture 2 is introduced directly, i.e. without a preceding ionization, into an ion trap 10 serving as measurement cell. An ionization device 12 serves for ionizing the gas mixture 2 directly in the ion trap 10, by virtue of ions 13*a* and/or metastable or excited particles 13*b* of an ionization gas 13 being supplied to the ion trap 10, which ions and/or particles ionize the gas mixture 2 by a charge exchange or impact ionization, typically in the ion trap 10. The ionization device 12 shown in FIG. 1 also has an electron beam source 20 in the form of an electron beam gun for producing electrons 20*a* with variable electron energies in the range between e.g. 1 eV and 100 eV, which electron beam source can be used in addition or as an alternative to the plasma source 18 and which is depicted by a dashed line in FIG. 1. The electrons 20*a* serve to ionize the gas mixture 2 directly in the ion trap 10 by electron impact ionization. In this way, the gas mixture 2 to be analyzed can be ionized, optionally accumulated and measured, directly in the measurement cell (ion trap 10), without transportation of the ionized gas mixture into the ion trap 10 being required. Alternatively, there can also be an ionization of the gas mixture 2 in the direct vicinity of the ion trap 10, wherein, in the latter case, there is a need for transportation of the ionized gas mixture to the ion trap 10.

In order to produce the primary ions 13*a* or the excited particles 13*b*, the (neutral) ionization gas 13 is removed from a gas reservoir 17 by a metering valve 15 and a gas supply line 16 and supplied to a plasma source 18. The ionization gas 13 is ionized or excited in the plasma source 18 and the ions 13*a* and/or metastable/excited particles 13*b* produced hereby are supplied to the ion trap 10 in order to bring about the charge exchange ionization or impact ionization of the gas mixture 2. The plasma source 18 can be a radiofrequency plasma source, medium frequency plasma source, DC plasma source, dielectric barrier discharge plasma source, atmospheric pressure plasma source, corona discharge plasma source, etc.

In the present example, the plasma source 18 is embodied to produce ions 13*a* and/or metastable particles 13*b* of the ionization gas 13 at a temperature of less than 100° C., i.e. the plasma discharge in the plasma source occurs at a low temperature (under 100° C.). By way of example, this can be achieved by applying an alternating radiofrequency field (with frequencies between 1 MHz and 30 MHz) since a corresponding RF discharge can advantageously occur at temperatures between 10° C. and 200° C. or it can be realized by the use of a DC plasma source specifically developed for this. It is understood that, in place of a plasma source 18, use can also be made of a different type of ionization device which is able to convert or ionize the (neutral) ionization gas 13 into an excited electron state in order to bring about an impact or charge exchange ionization of the gas mixture 2 in the ion trap 10.

A plurality of gases and gas mixtures can be used as ionization gas 13, e.g. He, $H_2$, Ar, $N_2$, Xe, Kr, $O_2$ etc. It was found to be particularly advantageous for a noble gas, in particular helium, to be used as ionization gas 13 which is converted into a metastable noble gas 13*b*, i.e. into noble gas particles (e.g. He*) which are in an excited electron state just before ionization, by the plasma source 18. A particularly sparing (cold) ionization with a small fragmentation of the analyte can be achieved, in particular, by a charge exchange between the analyte, i.e. a gas constituent 3*a*, 3*b* to be examined, and the metastable noble gas particle 13*b*.

This also renders it possible to ionize particles 3*b* with an atomic mass number of between 100 and 20,000, in particular between 20,000 and 2,000,000, as linked macromolecular structures, since these are not fragmented further by the cold RF plasma of the metastable noble gas particles 13*b*. By way of example, the particles 3*b* can be macromolecular mixtures with a particle size of approximately 0.001-10 μm or more. It is understood that, alternatively, the ionization gas, e.g. helium, can be present in a substantially completely ionized form (i.e. as $He^+$) and that mixed forms are also possible, for example the use of an ionization gas with non-negligible proportions of both $He^+$ and He*.

For particle measurement and characterization of large particles 3*b* with mass numbers up to 2,000,000 amu in the ion trap 10, it is possible to make use of the fact that the mass-to-charge ratio m/z to be detected depends as follows on the storage amplitude $V_{rf}$ (trajectory diameter) and field frequency $f_{rf}$ in the ion trap 10:

$$m/z \sim V_{rf}/(f_{rf})^2.$$

Consequently, it is possible to measure particles 3*b* with a very large mass by increasing the storage amplitude $V_{rf}$ and/or by reducing the field frequency $f_{rf}$ in the ion trap 10.

A further advantage of the use of metastable noble gas particles 13*b*, i.e. of neutral particles in an excited electron state, for the ionization of the gas mixture 2 in the ion trap 10 consists of the fact that these have a particularly large cross section, resulting in a larger impact probability with the constituents of the gas mixture 2 to be examined in the ion trap 10. As a result, the ionized particles 3*a*, 3*b* to be examined are collected more quickly in the centre of the ion trap 10, without a higher pressure of a buffer gas being required for this purpose. Thus, by using metastable noble gas particles 13*b* for ionizing the gas mixture 2, it is possible to carry out a measurement in the ion trap 10 significantly more quickly than in already known solutions, and so the mass spectrometer 1 can be used to record at least 10 spectra/s with a mass bandwidth of in each case at least 500 amu or 1000 amu.

As described further above, an electron beam source 20, which, in particular, can produce electrons 20*a* with variable electron energies in the range between e.g. 1 eV and 100 eV, can also be used in order to ionize constituents 3*a*, 3*b* of the gas mixture 2 with specific mass-to-charge ratios in a targeted manner. It is understood that, as an alternative to the example shown in FIG. 1, the ionization device 12 can have only a plasma source or only an electron beam source 20 in order to ionize the gas mixture 2 to be examined in the ion trap 10. The electrons 20*a* and/or the metastable particles 13*b* of the ionization gas 13 can also ionize residual gas 14 present in the ion trap 10, i.e. residual gas ions 14*a* are produced.

It is likewise possible to identify in FIG. 1 that the mass spectrometer 1 has a pressure reduction unit 11, which is attached to the inlet 6 of the measurement chamber 7 and which connects the measurement chamber 7 with the outlet 4 of the chamber 8. In the shown example, the pressure reduction unit 11 has three modular pressure stages 11*a-c*, connected in series, for reducing the gas pressure $p_0$ of the gas mixture 2 to be examined in the chamber 8. In the shown example, the mass spectrometer 1 is attached by flanges in the region of the outlet 4 of the chamber 8. The three pressure stages 11*a-c* each have two end-side flanges, via which they can be attached to the inlet 6 to the measurement chamber 7 or to one another.

Depending on the application, i.e. depending on the gas pressure $p_0$ of the gas mixture 2 in the chamber 8, it is possible to connect one, two or three or none of the pressure stages 11*a-c* in series in order to reduce the gas pressure so far that the gas mixture 2 can be supplied to the measurement chamber 7 for analysis purposes. The three pressure stages 11*a-c* are coordinated with one another. By way of example, the coordination can be realized by a pressure reduction by a factor of approximately 100-1000 mbar in each pressure stage 11*a-c*. It is possible to use all three pressure stages 11*a-c* in the case of a high gas pressure $p_0$ of the gas mixture to be examined (100 bar-$10^{-2}$ mbar), it is possible to use two pressure stages 11*a*, 11*b* in the case of a medium pressure ($10^{-2}$ mbar-$10^{-5}$ mbar) of the gas mixture 2 in the chamber 8, and it is possible to use only one or no pressure stage 11*a* in the case of a low gas pressure ($<10^{-5}$ mbar) of the gas mixture 2 in the chamber 8, through which pressure stages the gas mixture 2 is transported.

The pressure stages 11*a-c* can be connected in series by virtue of being attached to one another in a gas-tight manner, for example by virtue of these being screwed to one another on flanges. In this manner, it is possible to disassemble or reassemble the pressure stages 11*a-c* very quickly in order to serve a predefined pressure range of the gas pressure $p_0$ of the gas mixture 2 to be detected and to ensure that the gas pressure $p_0$ reduces to approximately $10^{-5}$ mbar or to $10^{-9}$ mbar in the direction of the ion trap 10 so that the ion trap 10 can be used for the gas analysis. By using one or more pressure stages 11*a-c*, it is possible to use the mass spectrometer 1 for examining gas mixtures 2 with a gas pressure $p_0$ between $10^5$ mbar and $10^{-15}$ mbar with an unchanging detection limit, wherein the mass spectrometer 1 can, in particular, be adapted to the desired pressure range in a particularly simple manner. Here, the (lower) detection limit can be defined as follows: it is possible to measure approximately 100 ions per second at a pressure of $10^{-8}$ mbar in the measurement chamber 7.

In the example shown in FIG. 1, the ion trap 10 is embodied as magnetic FT-ICR trap, which will be described in more detail below in conjunction with FIG. 2. In the magnetic FT-ICR trap 10, the ions 13*a* are trapped in a homogeneous magnetic field B, which extends along the Z-direction of an XYZ-coordinate system and forces the ions 13*a* trapped in the Z-direction in the FT-ICR trap 10 onto orbits with a mass-dependent orbital frequency. Furthermore, the FT-ICR trap 10 has an arrangement on which an alternating electric field is applied perpendicularly to the magnetic field B and therefore a cyclotron resonance is produced. In the shown example, the arrangement has six electrodes 21. If the frequency of the irradiated alternating field and the angular cyclotron frequency correspond, resonance occurs and the cyclotron radius of the relevant ion 13*a* increases by the take-up of energy from the alternating field. These changes lead to measurable signals on the electrodes 20 of the FT-ICR trap 10, which lead to a current flow I, which is supplied to an FFT (Fast Fourier Transform) spectrometer 23, likewise a component of the mass spectrometer 1, via an amplifier 22.

Figure 2:
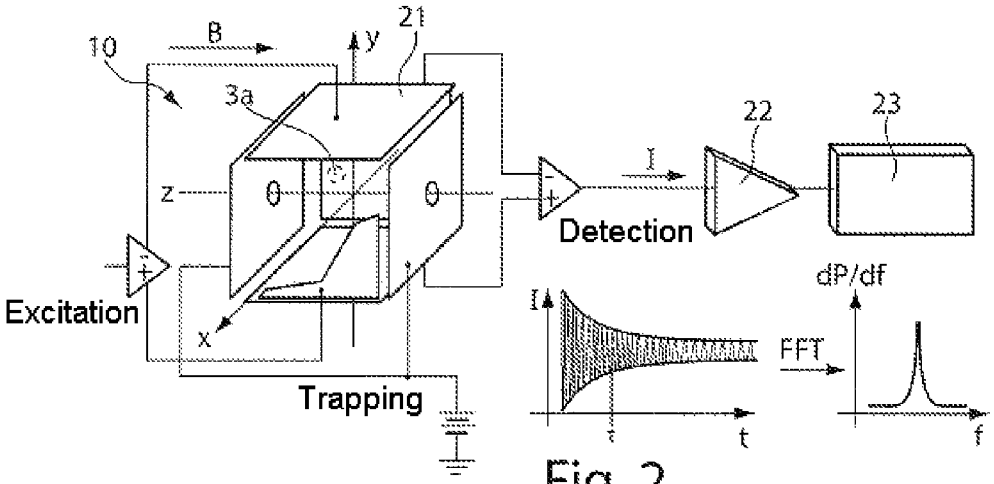
FIG. 2 shows a schematic illustration of an exemplary embodiment of an ion trap of the mass spectrometer in FIG. 1.

The time-dependent current I, received in the FFT spectrometer 23, is subjected to a Fourier transform in order to obtain the frequency f dependent mass spectrum, which is illustrated bottom right in FIG. 2. Thus, the FT-ICR trap 10 enables direct detection or direct recording of a mass spectrum, and so a fast gas analysis is rendered possible. It is also possible to selectively remove individual ions or ions with specific mass numbers or mass-to-charge ratios m/z from the FT-ICR trap 10, for example by virtue of an alternating field being applied to the electrodes 21 in order to guide the selected ions to be removed from the trap 10 onto unstable trajectories.

It is likewise possible to identify from FIG. 2 that the amplitude of the envelope of the time-dependent image current I reduces with time after excitation, wherein the decrease in time or the transient of the current I depends directly on the mean free path length and hence on the pressure in the FT-ICR trap 10. If an exponential decrease of the amplitude of the current I is assumed, it is possible to determine the pressure in the FT-ICR trap 10 with great accuracy on the basis of e.g. the time constant $\tau$, during which there is a reduction in the amplitude to a level of 1/e (i.e. approximately 37%) of the original value; this can be used, in particular, for determining the number of metastable particles (see below), since this number correlates with the pressure.

Fast recording of a mass spectrum with the aid of Fourier spectrometry can occur not only in the above-described FT-ICR trap 10, but also in developments of the trap type shown in FIG. 2. By way of example, the FT-ICR ion trap 10 can be embodied as so-called electric FT-ICR trap, which includes a ring electrode, to which a radiofrequency high voltage is applied, and two cover electrodes, which can serve both as image charge detectors and as excitation electrodes. In the compact electric variant of an FT-ICR trap 10, ions are held trapped by a radiofrequency high voltage. If the ions experience an impulse excitation, they carry out characteristic vibrations in the high vacuum, depending on the mass/charge ratio (m/z), which vibrations are recorded by image charge detection at the cover electrodes. A low-distortion ion signal is obtained by forming the difference from the image charge signals at both cover electrodes. Via the low-noise amplifier 22 and the spectrometer 23 for fast Fourier analysis (FFT) of the ion output signal, the characteristic ion frequencies and the intensities thereof can be depicted. The frequency spectrum can subsequently be converted into a mass spectrum, in which the number of detected particles is depicted depending on the mass-to-charge ratio m/z.

In order to obtain a quantitative analysis, which is as accurate as possible, of the gas mixture 2 to be examined or of the constituents 3*a*, 3*b* thereof, i.e. in order to determine as precisely as possible how many ions 13*a* are present in the ion trap 10 at a specific mass-to-charge ratio m/z, a continuous online in-situ calibration of the mass spectrometer 1 can be carried out. In the process, the number of primary ions, i.e. the ions 13*a* of the ionization gas 13 and the ions 14*a* of the residual gas, and the number 13*b* of the metastable particles of the ionization gas 13 which are available for the charge or impact ionization of the gas mixture 2 in the ion trap 10 are determined, as a result of which time fluctuations due to the variation or drift of the primary ions 13*a*, 14*a* or metastable particles 13*b* provided for the ionization can be practically completely eliminated.

Figure 3:
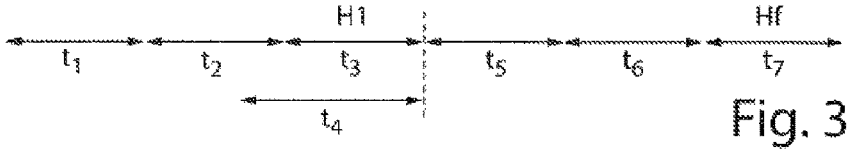
FIG. 3 shows a schematic illustration of the timing of a measurement process in the ion trap.

The above described result is possible due to a specific measurement procedure and a suitable control of the electronics of the mass spectrometer 1, which control is undertaken by a control device 19 (cf. FIG. 1). The timing of the measurement procedure is explained in more detail below on the basis of FIG. 3, wherein exemplary time durations t1 to t7 are specified for the individual steps of the measurement method.

In a first step (time duration t1 approximately 1 ms) there is an accumulation of the primary ions 13*a*, 14*a* in the ion trap 10. For accumulation purposes, the control device 19 opens the metering valve 15 and lets ionization gas 13 flow into the plasma source 18, in which the gas is ionized and where it enters the ion trap 10 in the form of ions 13*a*. Additionally, a residual gas 14, present in the ion trap 10, can be (partly) ionized by the metastable particles 13*b* of the ionization gas 13 and/or by the electrons 20*a* supplied to the ion trap 10 so that residual gas ions 14*a* are formed.

As soon as a sufficient number of primary ions 13*a*, 14*a* are accumulated in the ion trap 10, the primary ions 13*a*, 14*a* are excited in a second step (time duration t2 approximately 0.01 ms) by virtue of an excitation signal, likewise produced by the control device 19, being applied to the corresponding electrodes 21 of the ion trap 10. In a third step (time duration t3 approximately 0.1 ms) there is a measurement or detection of the number of primary ions 13*a*, 14*a* in the ion trap 10.

Just before the end of the second step and during the third step, a fourth step (time duration t4<1 ms) occurs in parallel, to be precise the transportation of the (non-ionized) gas mixture 2, more precisely a gas pulse 2*a* of the gas mixture 2, from the inlet 6 of the measurement chamber 7 into the ion trap 10. In order to produce the gas pulse 2*a*, the valve 5 is briefly actuated by the control device 19 and opened, with the time duration in which the valve 5 is opened typically lying in a region of less than approximately 1 μs or less than a few milliseconds. The control device 19 synchronizes the production of the gas pulse 2*a* of the gas mixture 2 with the step of measuring the number of primary ions 13*a* in such a way that the gas pulse reaches the ion trap 10 when the measurement of the number of primary ions 13*a*, 14*a* is complete. Optionally, the gas mixture 2 can also be ionized in the direct vicinity of the ion trap 10. In this case, the gas pulse reaches the ion trap 10 with a time offset, i.e. just after completion of the measurement of the number of primary ions. Since the gas pulse 2*a* moves toward the inlet of the ion trap 10, it is optionally possible to dispense with the provision of a transportation device for transporting the ionized gas mixture 2 into the ion trap 10.

In order to facilitate the flow of the gas mixture 2 or of the gas pulse from the chamber 8 into the ion trap 10, a transportation device, e.g. in the type of a fan, can be provided in the region of the valve 5, in the region of the outlet 4 from the chamber 8, in the region of the inlet 6 into the measurement chamber 7 and/or in the region between the inlet 6 and the ion trap 10. For the purposes of transporting the gas mixture 2 or a gas pulse to the ion trap 10, the measurement chamber 7 can also be connected to a pumping device (not shown in FIG. 1).

In a fifth step (time duration t5 approximately 0.1 ms) the gas mixture 2 transported in the gas pulse 2*a* is ionized in the ion trap 10 by impact ionization and/or by a charge exchange ionization via the primary ions 13*a*, 14*a* or via the metastable particles 13*b*. In the process, it was found to be advantageous if the flow of the ionization gas 13 or of the ions 13*a* and metastable particles 13*b* of the ionization gas 13 is directed counter to the flow direction of the gas pulse 2*a* such that the flow of the ionization gas 13 and the gas pulse 2*a* impact on one another in the interior of the ion trap 10. In order to achieve this, it is advantageous if, as shown in FIG. 1, the inlet 6 for supplying the gas pulse 2*a* and the inlet of the ionization device 12 for supplying the gas flow of the ionization gas 13 are arranged lying opposite one another. The same applies to the electron source 20 or the electron beam 20*a*, which should be likewise aligned with the gas pulse 2*a* or should be arranged lying opposite the inlet 6 for supplying the gas pulse 2*a*, as depicted in FIG. 1.

In a subsequent sixth step (time duration t6 approximately 1 ms) the ions of the gas mixture 2 are excited. Prior to or during the excitation of the ions of the gas mixture 2, the primary ions 13*a*, 14*a* can be removed from or suppressed in the ion trap 10 by virtue of a suitable excitation signal being produced and applied to the electrodes 20. In a subsequent seventh step (time duration t7=up to 100 ms) there is a measurement or detection of the excited ions or ionized constituents 3*a*, 3*b* of the gas mixture 2, wherein the measured signal level Hf is directly proportional to the ion number of the respective ion population in the corresponding mass-to-charge ratio m/z.

In order to minimize the influence of the time-dependent fluctuations in the number of primary ions 13*a*, 14*a*, provided for the ionization, or metastable particles 13*b* on the determination of the ion number Hf, the following procedure is adopted: the signal level Hf for each frequency for each mass-to-charge ratio m/z is determined by the following expression:

$$Hf(\text{corrected})=K*Hf(\text{uncorrected})*H1/\Sigma Hf, \quad (1),$$

where H1 denotes the signal level of all ions stably stored and excited in the ion trap, Hf(uncorrected) denotes the spectral level or signal level of the ion of interest or of the ionized constituent to be examined 3*a*, 3*b*, Σ Hf denotes the sum of all signal levels of the spectral lines present in the measured spectrum and K denotes a correction factor independent of mass and frequency, which includes the determined number of primary ions 13*a*, 14*b*, provided for the ionization, or metastable particles 13*b*, to be precise, in such a way that a larger determined number brings about a smaller correction factor K and vice versa. It is understood that it is generally sufficient to determine the number of metastable particles 13*b* in the case of an ionization gas 13 present substantially in the form of metastable particles 13*b* (e.g. He*) and that it is generally sufficient to determine the number thereof for the calibration in the case of an ionization gas 13 present substantially in the form of primary ions 13*a* (e.g. $He^+$).

By detecting the level Hf of the induced signal on the measurement electrodes 21 multiplied by the degree of excitation or the number H1 of all ions 13*a*, 14*a* stably stored and excited in the ion trap and by taking into account the correction factor K, it is possible to determine the actual number of ionized constituents 3*a*, 3*b* of the gas mixture 2, situated in the ion trap 10, at a predefined mass-to-charge ratio with a high degree of precision, i.e. typically with an inaccuracy of less than 5%. The degree of excitation specifies the ratio of the radius of the rollercoaster movement to the core radius of the ion cell. The above-described calibration can be carried out at all times, in particular during the actual measurement, for any selected gas types.

In principle, the procedure illustrated above can be repeated a number of times or any number of times. However, it may be advantageous if, after the ionization of the gas mixture 2, the ionized constituents 3*a*, 3*b* of the gas mixture 2 are excited repeatedly in the ion trap 10, without there being a re-ionization of the gas mixture 2 in the process, as is described below on the basis of FIG. 4.

Figure 4:
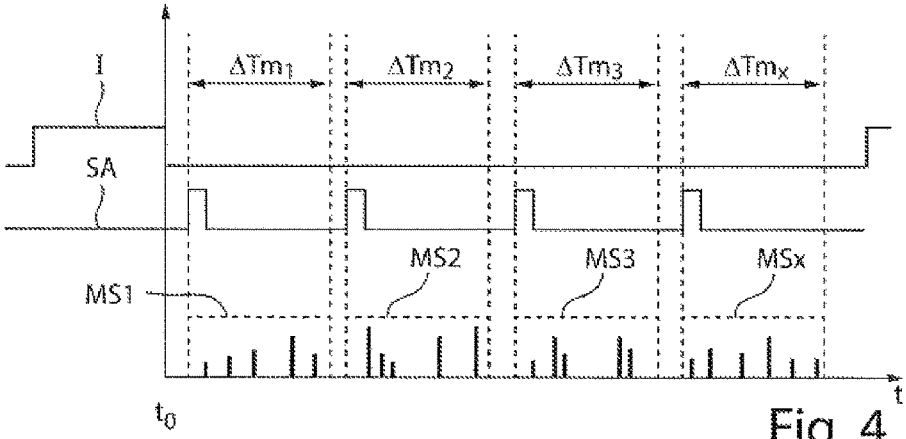
FIG. 4 shows a measurement process for evaluating a mass spectrum, in which a measurement window is displaced for realizing a fast measurement, and FIGS. 5*a,b* show two mass spectra, which are evaluated by the SWIFT process or by a mass-selective time multiplex measurement.

FIG. 4 shows an illustration of a measurement of ionized constituents 3*a*, 3*b* of the gas mixture 2 in the ion trap 10, in which there is an excitation (as desired, once to several tens of times) at a time to of the ionized constituents 3*a*, 3*b* of the gas mixture 2 with the aid of a pulsed excitation signal SA after the completion of the impact or charge exchange ionization, which is denoted by "I" in FIG. 4. A mass spectrum MS1 to MSx over an (in the present example) constant period of time ΔTm1 to ΔTmx (approximately 5 ms or less) is recorded during or after each excitation. In other words, a predefined measurement window (with the constant time duration) is repeatedly displaced in order to record respectively one mass spectrum MS1 to MSx during several successive excitations, without the need for a further ionization.

This renders it possible to undertake a very fast mass spectrometric analysis of the gaseous constituents 3*a*, 3*b* situated in the ion trap 10, as a result of which a chemical process proceeding during the measurement can be observed in real time. In particular, it is possible to measure the analyte molecules before these react with one another and it is possible to detect intermediate products which are formed during a chemical reaction. A mass spectrometer 1, in which the above-described measurement principle is applied, is suitable, in particular, for use in chemical process analysis.

In order to increase the dynamic range, i.e. the ratio between the maximum detectable signal strength and the minimal detectable signal strength, of the mass spectrometer 1, it is possible to evaluate a mass spectrum as described below on the basis of FIG. 5*a* and FIG. 5*b*.

Figure 5A:
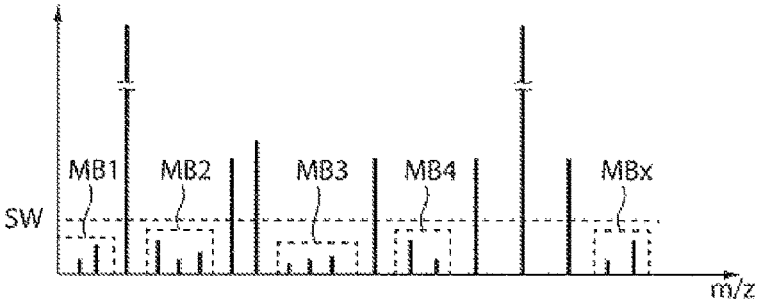

FIG. 5*a* shows a mass spectrum in which there is a so-called SWIFT excitation for increasing the dynamic response, in which relatively large ion populations, i.e. ion populations in which the particle number at a given mass-to-charge ratio m/z lies over a predefined threshold SW (cf. FIG. 5*a*), are removed from the ion trap 10 or suppressed during the measurement. In particular, the SWIFT excitation can be used to realize a comb filter, in which several subsets of ion populations, which each correspond to different measurement regions MB1 to MBx, i.e. to several intervals of mass-to-charge ratios, are measured simultaneously, as is indicated in FIG. 5*a*.

Figure 5B:
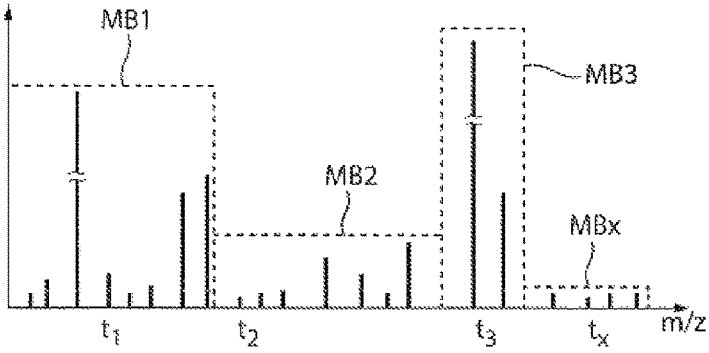

The dynamic response can also be increased by switching a measurement region, as is depicted in FIG. 5*b*. There, the mass spectrum is split into measurement regions MB1 to MBx with in each case different mass-to-charge ratios, wherein each measurement region MB1 to MBx is evaluated at a different measurement time t1 to tx. It is likewise possible to increase the dynamic range by such a temporal switch between the measurement ranges MB1 to MBx or by the mass-selective time multiplex measurement realized in this manner.

It is understood that the measurement modes described in conjunction with FIG. 5*a* and FIG. 5*b* can also be combined in order to increase the dynamic range. It is also possible to use more complicated types of measurement methods than the ones described here in order to further increase the dynamic range. Already when using one of the two measurement principles described in conjunction with FIG. 5*a* and FIG. 5*b*, it may optionally be possible to achieve a dynamic range of the mass spectrometer 1 of $10^8$:1 or more.

The option of accumulating individual ionized gas constituents of the gas mixture 2 in an ion trap 10 can be used in combination with the above-described measurement methods for increasing the dynamic range in order to reduce the detection limit of the mass spectrometer. What is used here is that ion trap mass spectrometers operate on a discontinuous basis and an analysis of the ion number only takes place after a predefined accumulation time (e.g. less than approximately 5 ms). By combining the above described processes for increasing the dynamic response (SWIFT or time multiplexing measurement, cf. FIG. 5*a* and FIG. 5*b*) with the accumulation ability of the ion trap 10, it is possible to accumulate individual ions until a sufficiently large measurement signal is present. In the case of a known (calibrated) measurement signal and a known accumulation time, the ion population to be examined can be determined quantitatively. In this manner, it is possible to lower the detection limit of the mass spectrometer to $10^{-15}$ mbar or less.

In addition to the types of ion traps described above, it is also possible to use other types of ion traps in the mass spectrometer 1, which ion traps enable three-dimensional storage or accumulation of ions and an evaluation via a Fourier transform, e.g. a Penning trap, toroidal trap, Paul trap, linear trap, orbitrap, EBIT and RF Buncher.

The above-described mass spectrometer 1 can find use in various fields of application. In addition to the chemical process analysis, which was already described as possible application in conjunction with FIG. 4, the mass spectrometer 1 can, for example, be used in EUV lithography for analysing the residual gas situated in an EUV system, e.g. an EUV lithography apparatus, in order to determine the concentration or the amount of contaminating substances in the residual gas atmosphere present there.

Figure 6:
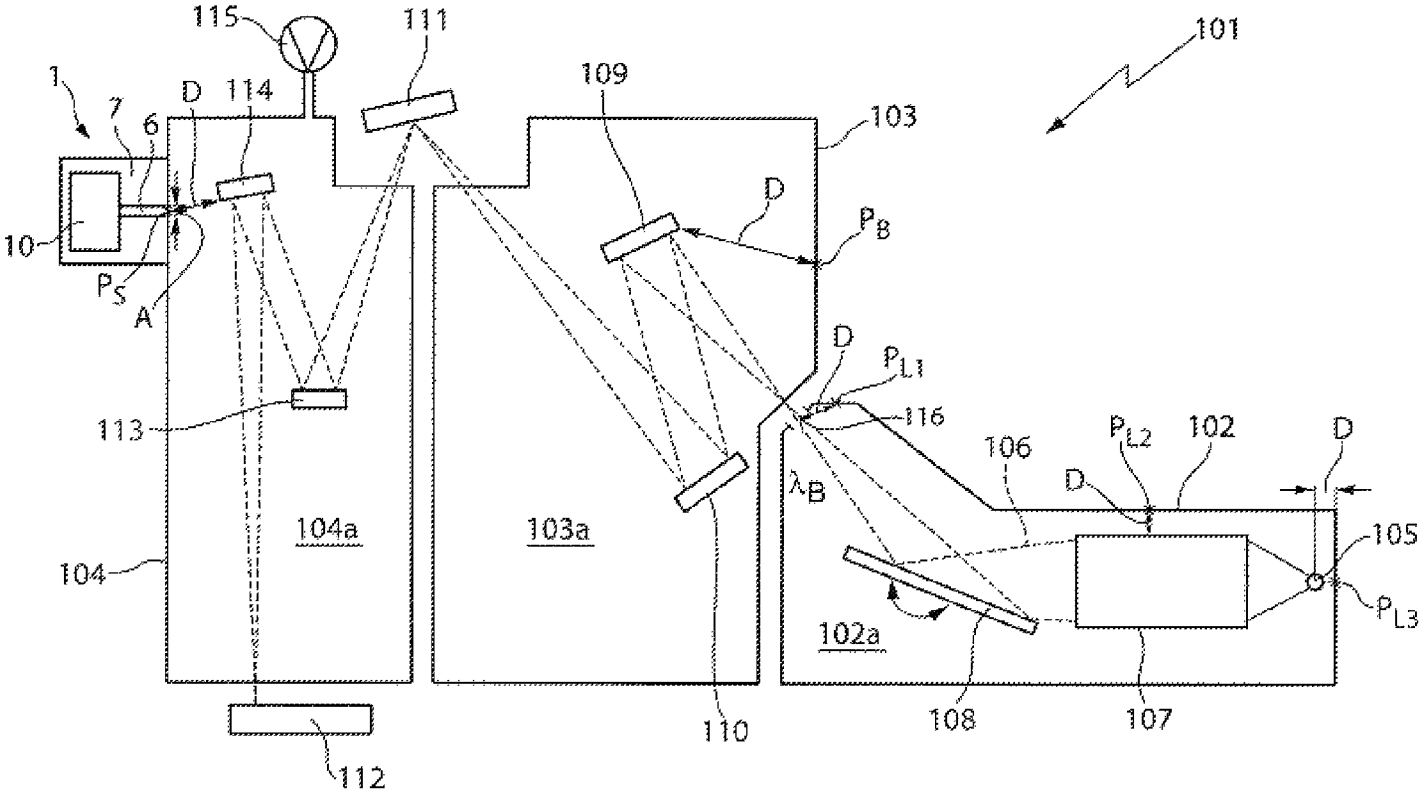
FIG. 6 shows a schematic illustration of an EUV lithography apparatus, which has a mass spectrometer.

FIG. 6 schematically shows such an EUV lithography apparatus 101. The EUV lithography apparatus 101 includes a radiation generating system 102, an illumination system 103 and a projection system 104 which are accommodated in separate vacuum housings and arranged successively in a beam path of the EUV radiation 106 generated by the EUV light source 105, the beam path proceeding from an EUV light source 105 of the radiation generating system 102. By way of example, a plasma source or a synchrotron can serve as EUV light source 105. The radiation in the wavelength range of between approximately 5 nm and approximately 20 nm that emerges from the EUV light source 105 is firstly concentrated in a collimator 107. With the aid of a downstream monochromator 108, the desired operating wavelength $\lambda_B$, which is approximately 13.5 nm in the present example, is filtered out by variation of the angle of incidence, as indicated by a double-headed arrow. The collimator 107 and the monochromator 108 are embodied as reflective optical elements.

The EUV radiation treated with respect to wavelength and spatial distribution in the radiation generating system 102 is introduced into the illumination system 103, which has a first and second reflective optical element 109, 110 (mirror). The two reflective optical elements 109, 110 guide the radiation onto a photomask 111 as a further reflective optical element, which has a structure that is imaged with a reduced scale on a wafer 112 via the projection system 104. To this end, a third and fourth reflective optical element 113, 114 (mirror) are provided in the projection system 104.

The reflective optical elements 109, 110, 111, 113, 114 each have an optical surface which is exposed to the EUV radiation 106 of the light source 105. The optical elements 109, 110, 111, 113, 115 are each operated under vacuum conditions in a residual gas atmosphere 102*a* of the radiation generation system 102, a residual gas atmosphere 103*a* of the illumination system 103 and a residual gas atmosphere 104*a* of the projection system 104, in which residual gas atmosphere there typically is a small proportion of air, hydrogen ($H_2$) and/or helium (He) and optionally further residual gases. Since the interior of the EUV lithography apparatus 1 cannot be baked out, the presence of undesirable contaminating constituents in the respective residual gas atmosphere 102*a*, 103*a*, 104*a* cannot be completely avoided.

During operation of the EUV lithography apparatus 1, a vacuum generation unit, which includes a vacuum pump 115, generates a residual gas atmosphere 104*a* with an overall pressure of typically more than $10^{-5}$ mbar in the projection system 104. A vacuum or a residual gas atmosphere 103*a*, 102*a* can correspondingly also be generated in the illumination system 103 or in the radiation generating system 102.

In order to determine the proportion of contaminating substances overall and/or individually for each contaminating substance in the residual gas atmosphere 104*a* of the projection system 104, in particular in the vicinity of the second mirror 114, a mass spectrometer 1 is connected by flanges to the projection system 104, which mass spectrometer 1 has a design as described further above, i.e. which has an inlet 6 in order to introduce the residual gas mixture situated in the projection system 104 directly, i.e. without a preceding ionization, into an ion trap 10, which serves as measurement cell and is arranged in a measurement chamber 7, in order to ionize the gas by e.g. a charge exchange or an impact ionization.

The inlet 6 forms a vacuum connection between the residual gas atmosphere 104*a* of the projection system 104 and the mass spectrometer 1. The inlet 6, i.e. the vacuum connection (vacuum pipe), has a cross section A of less than 100 mm, preferably less than 5 mm, in particular less than 1 mm. As shown in FIG. 1, the mass spectrometer 1 can have one or more stops to ensure that the residual gas pressure reduces toward the ion trap 10 to $<10^{-5}$ mbar so that a conventional residual gas analyzer can be used for the residual gas analysis.

It is likewise possible to identify in FIG. 6 that a distance D between the second mirror 114 and a connection position $P_S$ of the mass spectrometer 1, which is formed on the housing of the projection optical unit 104 in the middle of the vacuum connection or of the inlet 6, is less than 50 cm. This is advantageous for being able to detect as precisely as possible the portion or the partial pressure of contaminating substances which are present in the vicinity of the second mirror 114, more precisely in the vicinity of the optical surface thereof. During the mass spectrometric examination, it is possible, in particular, to measure or detect at least one of the following contaminating substances or the mixtures thereof: oxygen ($O_2$), ozone ($O_3$), water ($H_2O$), $C_XH_YO_Z$, typically up to 10 Mamu, and metal-$C_XH_YO_Z$-compounds, typically up to 10 Mamu.

Additionally, or alternatively, a further mass spectrometer or the mass spectrometer 1 can be provided at a connection position $P_B$ of the illumination system 103, which is arranged at a distance D of less than 50 cm from a mirror 109, 110, e.g. from the first mirror 109, arranged there.

Accordingly, the mass spectrometer 1 or a further mass spectrometer can be arranged at a first connection position $P_{L1}$ in the radiation generating system 102, which is arranged at a distance of less than 1 m, preferably less than 50 cm, away from a passage opening 116 for the passage of the EUV radiation 106 into the illumination system 103. The mass spectrometer 1 can also be located at a second connection position $P_{L2}$, which is arranged at a corresponding distance D of less than 100 cm, preferably less than 50 cm, from the collector 107 (typically in the form of a collector mirror), or at a third connection position $P_{L3}$, which is arranged at a distance of less than 100 cm, preferably less than 50 cm, from the EUV light source 105. In the manner described above, it is possible to determine the contamination level in the vicinity of the respective optical elements 114, 109, 116, 107 or in the vicinity of the EUV light source 105 with high precision.

Figure 7:
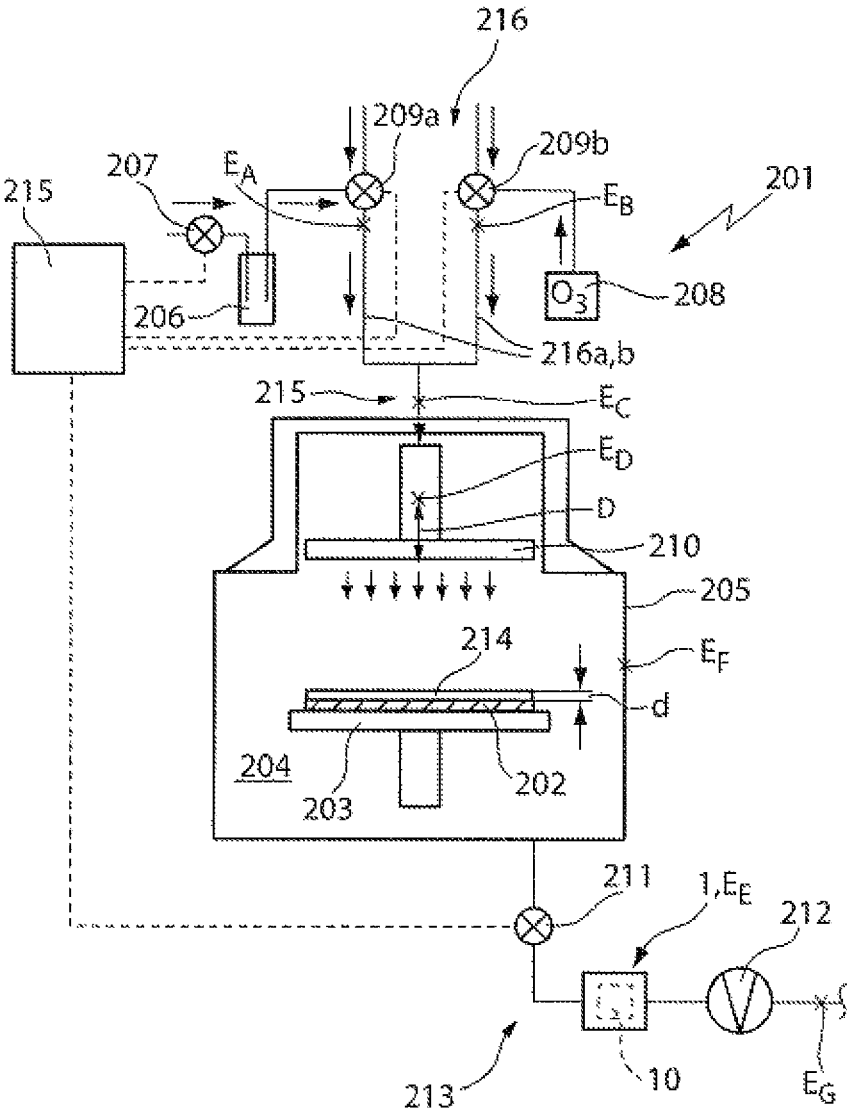
FIG. 7 shows a schematic illustration of a device for atomic layer deposition on a substrate, having a mass spectrometer.

FIG. 7 schematically shows a device 201 for atomic layer deposition on a substrate 202 (in this case: a silicon wafer), which is arranged on a mount 203 in an interior 204 of a process chamber 205 (reaction chamber). Both the mount 203 and the walls of the process chamber 205 can be heated to (optionally different) temperatures. The mount 203 can be connected to a motor to put the substrate 202 into a rotational movement during the coating. The device 201 also includes a container 206, in which a metal organic precursor material is contained, which, in the present example, is tetrakis(ethylmethylamino)hafnium (TEMAH) or another metal organic precursor. In order to move the precursor material from the container 206 to the process chamber 205, use is made of an inert carrier gas, e.g. argon or hydrogen, which can be supplied to the container 206 by a controllable valve 207. A further container 208 serves for the provision of ozone gas $O_3$ or another doping gas as reactant in atomic layer deposition.

The carrier gas with the precursor and the doping gas, for example the ozone gas, can in each case be introduced into the process chamber 205 by a controllable inlet in the form of a controllable valve 209*a*, 209*b*. A distributor manifold 210 is arranged in the chamber 205 in order to distribute the entering gas as homogeneous as possible in the direction on the substrate 202. Via the controllable valves 209*a*, 209*b*, it is also possible to supply a purge gas, e.g. argon, to the process chamber 205 in order to purge the process chamber 205 and the respective supply lines. A further controllable valve 211, which forms a gas outlet, is connected to a vacuum pump 212 in order to remove the gases from the process chamber 205. In order to monitor the residual gas atmosphere in the process chamber 205, a mass spectrometer 1 is arranged at an inclusion position $E_E$ in a vacuum line of a gas disposal system 213 formed downstream of the outlet valve 211, to be precise directly upstream of the vacuum pump 212. It is also possible to attach the mass spectrometer 1 to an inclusion position $E_G$ in an exhaust-gas line of the gas disposal system 213 downstream of the vacuum pump 212.

Additionally, or alternatively, a mass spectrometer 1 can also be formed at an inclusion position $E_A$, $E_B$ in a gas supply system 216 for supplying the reactants to the process chamber 205, for example in a respective supply line 216*a*, 216*b*. Additionally, or as an alternative thereto, a mass spectrometer 1 can also be integrated at an inclusion position $E_C$ of a gas mixing system 215, i.e. in a supply line formed downstream of the unification point of the two supply lines 216*a*, 216*b*. The latter is advantageous because the two supply lines 216*a*, 216*b* are not used simultaneously for supplying a gas to the process chamber 205 in the coating process described here. An inclusion position $E_D$ in the distributor manifold 210 is also possible, wherein the inclusion position $E_D$ in this case is preferably spaced at a distance D of less than 1 m, in particular of less than 50 cm, from the process chamber 205. Additionally, or as an alternative thereto, the mass spectrometer 1 or a further mass spectrometer and 1 can also be attached at an inclusion position $E_F$ on the housing of the process chamber 205, as described in conjunction with FIG. 6.

The mass spectrometer 1 serves for the detection or determination of the amount of partial pressure of at least one gaseous constituent which is contained in the residual gas atmosphere of the chamber 205 (inclusion position $E_F$) or which will be contained in the chamber 205 (inclusion positions $E_A$, $E_B$, $E_C$, $E_D$ upstream of the process chamber 205) or which has been contained therein (inclusion positions $E_E$, $E_G$ downstream of the process chamber 205). As shown on the basis of the mass spectrometer 1 arranged in the gas disposal system 213, the mass spectrometer has an ion trap 10, in which the gas or gas mixture to be examined can be ionized by e.g. a charge exchange or an impact ionization. In order to bring about a gas flow of the ionized gas constituents into the ion trap 10, the mass spectrometer 1 can be connected to a vacuum pump (not shown). The ions stored in the ion trap 10 can be detected directly in the ion trap 10.

In order to apply a coating 214 of hafnium oxide ($HfO_2$) onto the substrate 202, the following procedure is followed: initially, the carrier gas with the TEMAH-precursor is supplied to the process chamber 205 via the first valve 209*a*. Then, the first valve 209*a* is switched and the purge gas is supplied to the process chamber 205 by the first valve 209*a* (cf. arrow) and the latter is, together with the residues of the carrier gas or the precursor, suctioned away through the opened outlet valve 211 via the vacuum pump 212. After purging, the outlet valve 211 is closed and ozone or a doping gas is introduced into the chamber 205 via the second valve 209*b*, which ozone or doping gas undergoes chemical reaction with the precursor on the exposed surface of the substrate 202. Subsequently, there is a purging of the chamber 205 via the purge gas, which is supplied to the chamber via the second valve 209*b* (cf. arrow) and which is, together with the ozone or doping gas residues or possibly formed reaction products, suctioned away via the vacuum pump 212 when the outlet valve 211 is opened. In the procedure described above, a mono-layer made of hafnium oxide is deposited on the substrate 202. After closing the outlet valve 211, this procedure can be repeated a number of times, to be precise until the $HfO_2$ coating 214 has reached a desired thickness d.

The time duration for supplying the carrier gas with the precursor, the time duration for supplying the ozone or doping gas and the time duration of the purge procedure typically lie in the range of seconds. A control device 215 serves to actuate the valves 207, 209*a*, 209*b*, 211 so as to switch between the above-described steps of the deposition process. It is understood that the control device 215 can not only switch the valves 207, 209*a*, 209*b*, 211 between an opened position and a closed position, but that, optionally, the mass flow, which flows through the respective valves 207, 209*a*, 209*b*, 211, can also be controlled via the electronic control device 215.

The overall pressure of the residual gas in the process chamber 205 typically lies between approximately $10^{-3}$ mbar and 1000 mbar, wherein comparatively high overall pressures of more than 500 mbar or more than 900 mbar are also possible. The overall pressure in the chamber 205 can be monitored via a pressure sensor (not shown) and can optionally be modified via the control device 215 by a suitable control of the valves 207, 209*a*, 209*b*, 211.

The detection of the gaseous constituents, more precisely determining the amount or the partial pressure of a respectively detected gaseous constituent, can be used for controlling or regulating the deposition process. By way of example, on the basis of the concentration of the metal organic precursor or of process relevant reactants such as ozone, doping gas or optionally metal organics and/or $H_2O$ in the residual gas atmosphere, it is possible to identify when the purging step can be completed (e.g. as soon as the respective partial pressure falls under a predefined threshold). The control unit 215, which has a signal connection to the process gas analyzer 213*a*, can then open or close the respective inlet valve 209*a*, 209*b* or the outlet valve 211 at suitable times and thus optimize the time duration used for the purging step. It is understood that, analogously, an optimization of the time duration of the two above-described supply steps is also possible.

With the aid of the mass spectrometer 1, it is not only possible to optimize a process during the atomic layer deposition, but rather there can also be an optimization in other coating processes, for example when carrying out a (optionally plasma assisted) CVD process, a metal organic CVD process, in the case of metal organic chemical vapour phase epitaxy or in the case of molecular beam epitaxy, which can typically likewise be carried out in the (optionally slightly modified) device 1 from FIG. 1. The same applies to coating processes based on physical vapour deposition. In all of these cases, it is possible to adapt or optimize the process parameters (temperature, pressure, etc) in a suitable manner on the basis of the detected gas constituents in the residual gas atmosphere.

When the mass spectrometer 1 is used in a coating apparatus, in particular, at least one of the following substances, the mixtures and/or reaction products, clusters and/or compounds thereof can be measured or detected during the mass spectrometric examination: $H_2$, He, $N_2$, $O_2$, $PH_3$, $AsH_3$, B, P, As, $CH_4$, CO, $CO_2$, Ar, $SCl_4$, $SiHCl_3$, $SiH_2Cl_2$, $H_2O$, $C_xH_y$, trimethylgallium, triethylgallium, trimethylaluminium, triethylaluminium, trimethylindium, triethylindium, $Cp_2Mg$, $SiH_4$, $Si_2H_6$, tetrabutylammonium, tetrabutylsilane, Xe isotropes, Kr isotropes, hexamethyldisiloxane, tert-butylarsine, trimethylarsine, diethyl-tert-butylarsine, diethyl-tert-butylphosphine, di-tert-butylphosphine, tert-butylhydrazine, dimethylhydrazine, indium, aluminium, gallium, boron, silicon, gold, antimony, bismuth.

The at least one substance, the mixture, the reaction product, the cluster and/or the compound can, in particular, be measured or detected at a temperature in the process chamber 205 of between 15° C. and 5000° C., preferably between 100° C. and 2000° C., and at a pressure in the process chamber 205 of between $10^{-10}$ mbar and 5 bar, preferably between $10^{-8}$ mbar and 1 bar.

In particular, when using the mass spectrometer 1 for examining a (process) gas mixture during a coating process, it can be advantageous if the mass spectrometer 1 has a self-cleaning function in order to remove constituents of the process gas which are deposited in the measurement chamber 7 or in the ion trap 10. An option for realizing such an in-situ self-cleaning is described in WO 02/00962 A1, in which a cleaning gas is used for removing deposits produced by process gases. In the mass spectrometer 1 from FIG. 1, the cleaning gas can be converted into a plasma in the plasma source 18 by virtue of the cleaning gas being supplied by a gas supply (not depicted here) in place of the ionization gas 13. The ionized or excited cleaning gas enters the ion trap 10 on the same path as the ionization gas 13. Optionally, the cleaning gas can also enter the measurement chamber 7 via a further gas supply (not depicted here) and, there, form a gaseous cleaning product with the deposits, which cleaning product can be removed from the ion trap 10 or from the measurement chamber 7.

In particular, if the ion trap 10 is embodied as an electric FT-ICR trap, which uses a small installation space, the mass spectrometer 1 can also be used in applications in which the installation space plays an important role, e.g. in MOCVD processes or the like.

It is understood that, due to the properties thereof described above, the mass spectrometer 1 can also be used in other fields, for example in other coating or etching or implanting processes, in gas analysis, in doping tests, in forensic examinations, etc.

In addition to the use of the above-described mass spectrometer for mass spectrometric examination of gases, it is also possible to use the mass spectrometer in the field of vibration detection or vibration analysis of, typically, mechanical vibrations. In particular, the vibrations can be natural vibrations of a setup or a device, into which the mass spectrometer is installed, i.e. the vibrations are detected at the point of use of the mass spectrometer and the mass spectrometer is used as vibration sensor. For this purpose, the mass spectrometer is used to record a spectrum within a frequency range in which the vibration frequencies to be analyzed lie. By way of example, this frequency spectrum can lie between approximately 1 Hz and approximately 15 kHz. A plurality of parasitic frequencies typically lie within this frequency range, which parasitic frequencies are produced by mechanical vibrations and which can be detected and analyzed by the measurement electrodes of e.g. an FT ion trap, in particular an FT-ICR trap. By way of example, in order to analyze the vibrations, a frequency spectrum can be recorded as soon as the mass spectrometer is installed into the device. If the device was in good working order at the time of the installation, this frequency spectrum can serve as reference spectrum. Measuring the frequency spectrum can be repeated at a later time or at several later times, and the measured frequency spectrum can be compared to the reference spectrum. If one or more additional lines or peaks are detected in the measured frequency spectrum, this is an indication that undesired vibrations are occurring somewhere in the device, which e.g. can be traced back to mechanical problems. By way of example, the vibrations can be undesired natural vibrations of sliding bearings or ball bearings, which are arranged in the vicinity of the mass spectrometer, or vibrations caused by a power supply unit (mains hum). By way of example, in the coating apparatus 201 depicted in FIG. 7, the natural frequencies f of the vacuum pump 212 arranged in the vicinity of the mass spectrometer 1, in particular the sliding bearings or ball bearings of the pump, can be analyzed or detected.

What is claimed is:

1. A mass spectrometer, comprising:

an ionization device configured to provide an ionization component which comprises at least one member selected from the group consisting of: a) ions of an ionization gas; and b) metastable particles of the ionization gas;

an ion trap configured to store and mass spectrometrically examine a gas mixture in the ion trap; and a controllable inlet configured to provide a pulsed supply of the gas mixture to the ion trap, wherein the mass spectrometer is configured so that, during use of the mass spectrometer:

the ionization device provides the ionization component to the ion trap and the controllable inlet provides the pulsed gas supply to the ion trap so that the ionization component ionizes the gas mixture in the ion trap via a charge exchange process and/or impact ionization;

determines a number of a substance which comprises at least one member selected from the group consisting of: a) ions of the ionization gas present in the ion trap; b) metastable particles of the ionization gas present in the ion trap; and c) ions of a residual gas present in the ion trap prior to examining the gas mixture; and reduces an influence of fluctuations of the ionization component by determining a particle number of ionized constituents of the gas mixture in the ion trap in a pulsed manner using a correction factor that takes into account the determined number of the substance.

2. The mass spectrometer of claim 1, wherein the mass spectrometer is configured to determine a particle number of an ionized constituent of the gas mixture in the ion trap with an inaccuracy of less than 5%.

3. The mass spectrometer of claim 1, wherein the ionization device is configured to supply metastable particles of an ionization gas in the form of a metastable noble gas.

4. The mass spectrometer of claim 3, wherein the mass spectrometer is configured to record at least 10 spectra per second with a mass bandwidth of 500 atomic mass units in each case.

5. The mass spectrometer of claim 1, further comprising a plasma source configured to produce the ionization component.

6. The mass spectrometer of claim 5, wherein the plasma source is configured to produce the ionization component at a temperature of less than 100° C.

7. The mass spectrometer of claim 1, wherein the mass spectrometer is configured so that, when a number of ionized constituents of the gas mixture present in the ion trap exceeds a threshold, the mass spectrometer removes at least some of the of ionized constituents from the ion trap.

8. The mass spectrometer of claim 1, wherein the mass spectrometer is configured to selectively detect ionized constituents of the gas mixture in predefined measurement ranges of mass-to-charge ratio.

9. The mass spectrometer of claim 1, wherein the mass spectrometer has a dynamic range of $10^8$ or more.

10. The mass spectrometer of claim 1, wherein the ion trap is configured to accumulate individual ionized gas constituents of the gas mixture, and the mass spectrometer has a detection limit of $10^{-15}$ millibar or less.

11. The mass spectrometer of claim 1, further comprising a pressure reduction unit which comprises at least one modular pressure stages configured to be connected in series to reduce the gas pressure of the gas mixture.

12. The mass spectrometer of claim 1, wherein the mass spectrometer is configured to examine gas mixtures with a gas pressure of between $10^5$ millibar and $10^{-15}$ millibar.

13. The mass spectrometer of claim 1, wherein the mass spectrometer is configured to: a) repeatedly excite ionized constituents of the gas mixture in the ion trap; and b) record a mass spectrum of the ionized constituents to be examined during a predetermined time duration of each excitation.

14. The mass spectrometer of claim 13, wherein the time duration for recording a mass spectrum is five milliseconds or less.

15. The mass spectrometer of claim 1, wherein the ion trap comprises a member selected from the group consisting of a Fourier transform ion trap, a Penning trap, a toroidal trap, a Paul trap, a linear trap, an orbitrap, an EBIT, and a nRF buncher.

16. The mass spectrometer of claim 1, wherein the mass spectrometer is configured to detect vibrations with a vibration frequency of between 1 Hz and 15 kHz.

17. The mass spectrometer of claim 1, wherein the mass spectrometer is configured to determine a number of ions present in the ion trap.

18. The mass spectrometer of claim 17, wherein the mass spectrometer is configured to determine a particle number of ionized constituents of the gas mixture in the ion trap, taking into account the determined number of ions present in the ion trap.

19. The mass spectrometer of claim 1, wherein:

the ionization component comprises metastable particles of the ionization gas; and the mass spectrometer is configured to determine a number of the metastable particles of the ionization gas present in the ion trap.

20. The mass spectrometer of claim 19, wherein the mass spectrometer is configured to determine a particle number of ionized constituents of the gas mixture in the ion trap, taking into account the determined number of metastable particles of the ionization gas present in the ion trap.

21. The mass spectrometer of claim 1, wherein the mass spectrometer is configured so that, during use of the mass spectrometer:

an increase in the determined particle number results in a decrease in the correction factor; and a decrease in the determined particle number results in an increase in the correction factor.

22. The mass spectrometer of claim 1, wherein the mass spectrometer is configured to:

supply to the ion trap metastable particles of the ionization gas;

determine the number of i) metastable particles of the ionization gas present in the ion trap; and ii) ions of a residual gas present in the ion trap prior to examining the gas mixture; and reduce the influence of fluctuations of the ions or metastable particles provided for the ionization by determining a particle number of ionized constituents of the gas mixture in the ion trap in a pulsed manner using a correction factor that takes into account the determined number of at least one member selected from the group consisting of: i) metastable particles of the ionization gas; and ii) ions of the residual gas.

23. The mass spectrometer of claim 22, wherein the metastable particles of the ionization gas are electrically neutral.

24. A lithography apparatus, comprising the mass spectrometer of claim 1.

25. The lithography apparatus of claim 24, wherein the lithography apparatus is an EUV lithography apparatus.

26. The lithography apparatus of claim 25, wherein the EUV lithography apparatus comprises a projection system, and the mass spectrometer is connected to the projection system.

* * * * *